United States Patent [19]

Anno et al.

[11] Patent Number: 5,034,300

[45] Date of Patent: Jul. 23, 1991

[54] CHARGING MEANS WITH IMIDAZOLE DERIVATIVES FOR USE IN DEVELOPING DEVICE AND METHOD OF DEVELOPING

[75] Inventors: Masahiro Anno; Hideaki Ueda, both of Osaka, Japan

[73] Assignee: Minolta Camera Kabushiki Kaisha, Osaka, Japan

[21] Appl. No.: 456,866

[22] Filed: Dec. 27, 1989

[30] Foreign Application Priority Data

| | | | |
|---|---|---|---|
| Dec. 28, 1988 | [JP] | Japan | 63-331734 |
| Dec. 28, 1988 | [JP] | Japan | 63-331735 |
| Dec. 28, 1988 | [JP] | Japan | 63-331736 |
| Dec. 28, 1988 | [JP] | Japan | 63-331737 |
| Dec. 28, 1988 | [JP] | Japan | 63-331738 |

[51] Int. Cl.[5] ..... G03G 13/08; G03G 15/08

[52] U.S. Cl. ..... 430/120; 430/97; 430/108; 361/226; 118/653

[58] Field of Search ..... 430/97, 108, 120; 118/653; 361/226

[56] References Cited

U.S. PATENT DOCUMENTS

| | | | |
|---|---|---|---|
| 4,522,907 | 6/1985 | Mitsuhashi et al. | 361/226 X |
| 4,841,331 | 6/1989 | Nakayama et al. | 361/226 X |

FOREIGN PATENT DOCUMENTS

| | | | |
|---|---|---|---|
| 221851 | 12/1983 | Japan | 430/108 |
| 128258 | 6/1986 | Japan | 430/108 |
| 61-259262 | 11/1986 | Japan . | |
| 61-259263 | 11/1986 | Japan . | |
| 61-259264 | 11/1986 | Japan . | |
| 61-259265 | 11/1986 | Japan . | |
| 61-259266 | 11/1986 | Japan . | |
| 61-259267 | 11/1986 | Japan . | |
| 61-259269 | 11/1986 | Japan . | |
| 61-259270 | 11/1986 | Japan . | |
| 61-259271 | 11/1986 | Japan . | |
| 61-269268 | 11/1986 | Japan . | |
| 68566 | 3/1990 | Japan | 430/108 |
| 68567 | 3/1990 | Japan | 430/108 |

*Primary Examiner*—Roland Martin

*Attorney, Agent, or Firm*—Burns, Doane, Swecker & Mathis

[57] ABSTRACT

This invention relates to charging means which contacts with a toner to charge the toner and being installed in a developing machine for developing electrostatic latent images by a dry developer; the charging means comprises a specified imidazole compound selected from the group consisting of an imidazole metal complex, an imidazole metal compound and an imidazole derivative.

37 Claims, 2 Drawing Sheets

CHARGING MEANS WITH IMIDAZOLE DERIVATIVES FOR USE IN DEVELOPING DEVICE AND METHOD OF DEVELOPING

BACKGROUND OF THE INVENTION

This invention relates to charging means which cause a toner for developing electrostatic latent image to charge.

A toner is charged positively or negatively according to the polarity of electrostatic latent images.

Only tribo-chargeability of a toner-constituting resin may be utilized to charge a toner. However, as sufficient charge amounts are not provided by this method, copied images become unclear and many fogs generate in the copied images. Therefore, a charge controlling agent such as a dye, a pigment or the like which reinforces chargeability is added in general to a toner to achieve a desired level of charge amounts.

However, particles of a charge controlling agent must be cropped out on a surface of a toner in order to enhance chargeability of the toner by adding these additives into the toner. Therefore, particles of additives drop out of toner surfaces by the friction between toner particles themselves, the collision between a toner and a carrier, the friction between a toner and a support of electrostatic latent images or the like, to pollute a carrier, a support of electrostatic latent images, a belt for a photosensitive member, a drum for a photosensitive member. As a result, chargeability becomes poor, and further the repetition of a copying process causes problems such as the decline in image density, the deterioration of reproducability of fine lines, the increase of fogs and the like.

It is proposed that the improvement of charging properties of a toner is achieved not only by the addition of additives into a toner but also by a transporting member, a toner-levelling member or a friction member (hereinafter, a material or a member which contacts with a toner in a developing process or prior to a developing process to provide a toner with charges necessary for development or to provide a toner with charge auxiliaryly is referred to as "charging means" in a general term, including the transporting member, the toner-levelling member and the friction member.)

Charging means can provide a toner with charges sufficiently, thereby, the addition of additives into toner for the improvement of chargeability is not almost needed. Therefore, it become possible to achieve the essential improvement for the problems as above mentioned.

However, charging means such as a carrier, a sleeve, a doctor blade or the like must possess not only a strong ability to giving charges but also excellent permanence such as friction resistance to a toner.

Recently, the miniaturization of a developer is required for the miniaturization of a copying machine, the low cost or a multi-color printing of a copying machine. Further, a developer is required to be used in an unit system from the view point of a maintenance service. A single component developing system has been paid attention to because of those requirements as above mentioned. However, it is difficult to charge a toner uniformly, because a toner is charged at the moment the toner passes through between a toner-levelling blade and a sleeve. It is proposed to overcome these defects as above mentioned that a surface of a toner-levelling blade is coated with a resin or the like having strong chargeability. It is also proposed for further improvement of chargeability that a charge controlling agent is contained in a resin-coating layer. However, electrification build-up properties and stabilization of charges are not improved satisfactorily.

SUMMARY OF THE INVENTION

The object of the invention is to provide charging means comprising specified imidazoles, which can charge a toner to a suitable charging level and effects the improvement of electrification build-up properties and chargeability of a toner.

Another object of the invention is to provide charging means which is not deteriorated even if it is used for a long time.

The present invention relates to charging means which contacts with a toner to charge the toner and being installed in a developing machine for developing electrostatic latent images by a dry developer, said charging means comprising an imidazole compound selected from the group consisting of an imidazole metal complex represented by the general formula [I] below, an imidazole metal compound represented by the general formula [II] below; and an imidazole derivative represented by the general formula [III] below;

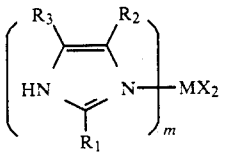

[I]

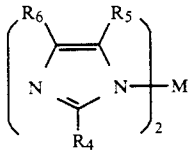

[II]

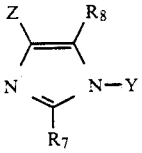

[III]

wherein $R_1$, $R_4$ and $R_7$ are respectively an alkyl group, an aralkyl group or an aryl group; $R_2$, $R_3$, $R_5$, $R_6$ and $R_8$ are respectively a hydrogen atom, an alkyl group, an aralkyl group or an aryl group; M is a metal selected from the group consisting of Zn, Fe, Co, Ni, Cu and Hg; X represents a halogen atom, a hydroxy group or an ionic residual group of one valency; m is an integer of 2, 4 or 6 and being 2 or 4 when M is Fe or Ni, 2, 4 or 6 when M is Cu or Co, and 2 when M is Zn or Hg; Y represents a hydrogen atom or a group represented by the formula [IV];

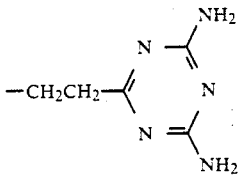

[IV]

Z represents an hydrogen atom, an alkyl group, an aralkyl group, an aryl group, a group represented by the general formula [V] below;

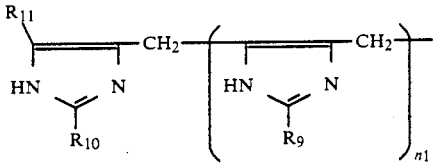

[V]

or a group represented by the general formula [VI];

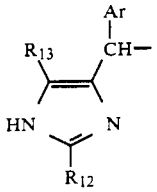

[VI]

wherein $R_9$, $R_{10}$ and $R_{12}$ are respectively an alkyl group, and aralkyl group or an aryl group; $R_{11}$ and $R_{13}$ are respectively a hydrogen atom, an alkyl group, an aralkyl group or an aryl group; Ar is an aryl group or a residual group of heterocyclic ring; $n_1$ is zero or an integer of more than 1.

DETAILED DESCRIPTION OF THE INVENTION

Figure 1:
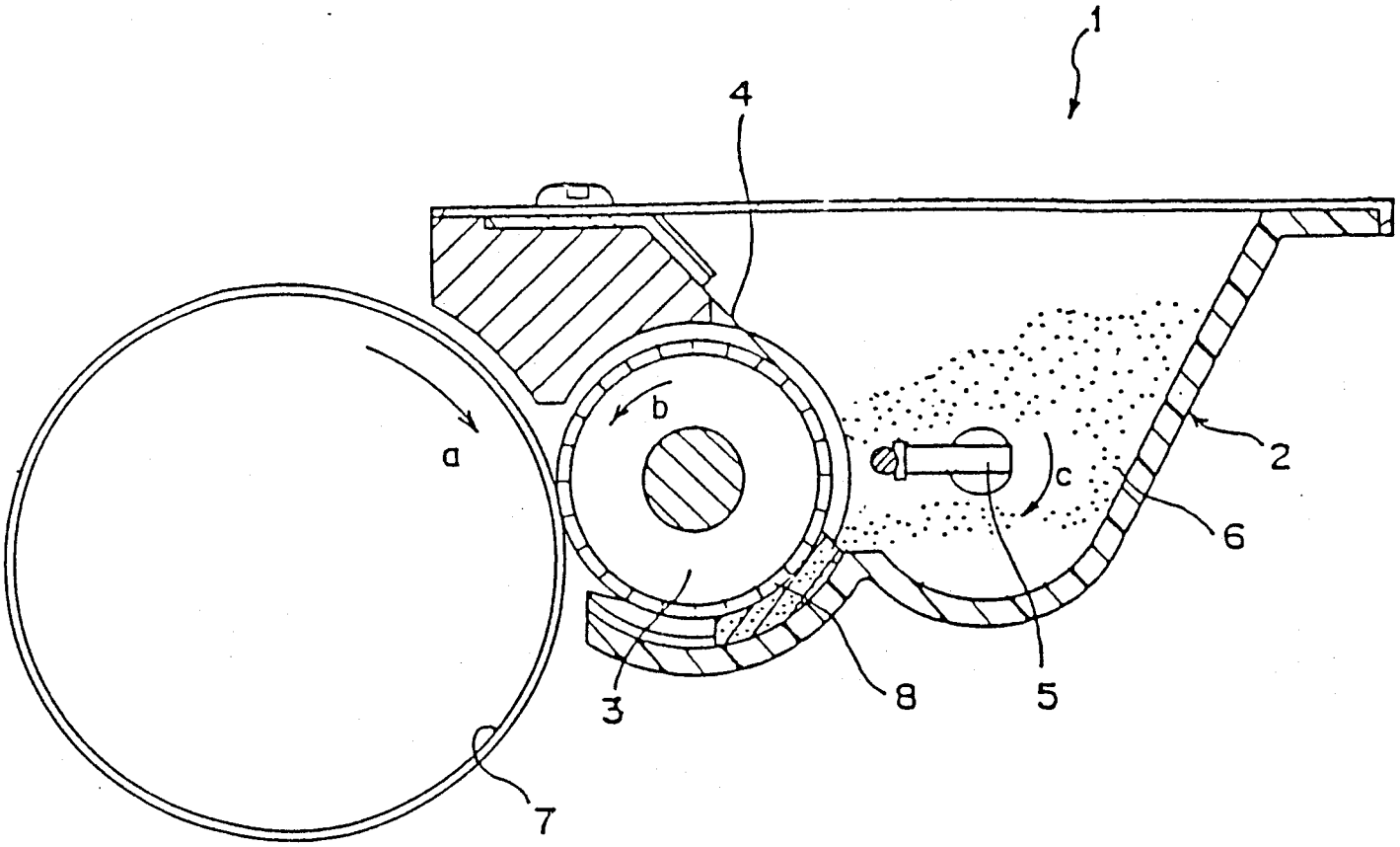
FIG. 1 and FIG. 2 show respectively a schematic view of a developing machine constituted of a toner-levelling member and/or a toner-transporting member of the present invention.

The present invention provides charging means which can charge a toner to a suitable charging level and effects the improvement of electrification build-up properties and chargeability of a toner.

The present invention has accomplished the above object by introducing a specific imidazole compound as a charge enhancing material into charging means.

A developing machine for developing electrostatic latent images by a dry developer is equipped with charging means which contacts with a toner to charge the toner.

Charging means of the present invention contains a specific imidazole compound selected from the group consisting of an imidazole metal complex represented by the general formula [I] below, an imidazole metal compound represented by the general formula [II] below; and an imidazole derivative represented by the general formula [III] below;

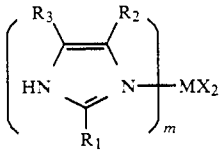

[I]

-continued

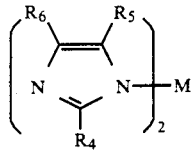

[II]

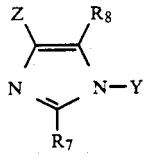

[III]

wherein $R_1$, $R_4$ and $R_7$ are respectively an alkyl group, an aralkyl group or an aryl group; $R_2$, $R_3$, $R_5$, $R_6$ and $R_8$ are respectively a hydrogen atom, an alkyl group, an aralkyl group or an aryl group; M is a metal selected from the group consisting of Zn, Fe, Co, Ni, Cu and Hg; X represents a halogen atom, a hydroxy group or an ionic residual group of one valency; m is an integer of 2, 4 or 6 and being 2 or 4 when M is Fe or Ni, 2, 4 or 6 when M is Cu or Co, and 2 when M is Zn or Hg; Y represents a hydrogen atom or a group represented by the formula [IV];

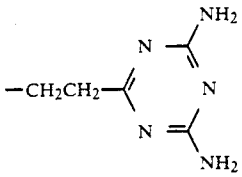

[IV]

Z represents an hydrogen atom, an alkyl group, an aralkyl group, an aryl group, a group represented by the general formula [V] below;

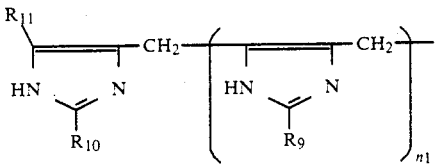

[V]

or a group represented by the general formula [VI];

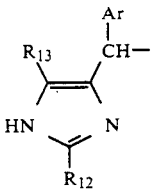

[VI]

wherein $R_9$, $R_{10}$ and $R_{12}$ are respectively an alkyl group, an aralkyl group or an aryl group; $R_{11}$ and $R_{13}$ are respectively a hydrogen atom, an alkyl group, an aralkyl group or an aryl group; Ar is an aryl group or a residual group of heterocyclic ring; $n_1$ is zero or an integer of more than 1.

An imidazole compound represented by the general formula [I], [II] or [III] may be incorporated into charging means directly, or into a resin coat layer covering charging means. Thereby, charging means can charge a toner to a suitable level.

In the general formula [I], $R_1$ is a $C_1$–$C_{35}$ alkyl group (which may be branched), an aralkyl group such as benzyl and phenethyl, or an aryl group such as phenyl.

In the general formula [I], $R_2$ and $R_3$ are independently a hydrogen atom, a $C_1$–$C_{35}$ alkyl group (which may be branched), an aralkyl group such as benzyl or phenethyl or aryl group such as phenyl.

X is a halogen atom, an ion residual group of one valence such as a nitric acid or acetic acid, or a hydroxy group.

M is a metal selected from the group consisting of Zn, Fe, Co, Ni, Cu, and Hg. m is an integer of 2 when M is Fe or Ni, 2, 4 or 6 when M is Cu or Co, and 2 when M is Zn or Hg.

An imidazole metal complex represented by the general formula [I] may be synthesized by dissolving an imidazole compound represented by the formula [i];

[i]

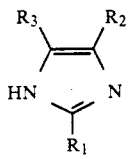

[$R_1$, $R_2$ and $R_3$ are same as above mentioned ] and $MX_2$ [M and X are same as above mentioned] in an alcohol solvent such as methanol and ethanol or an aromatic solvent such as benzene and toluene to mix them, and the resultant mixture is concentrated.

An imidazole zinc compound of the present invention represented by the general formula [I] is shown below, but they are shown with no significance in restricting the embodiment of the invention.

[I-1]

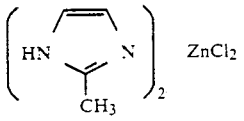

[I-2]

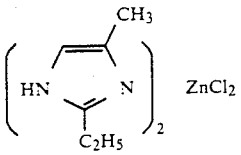

[I-3]

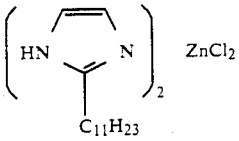

[I-4]

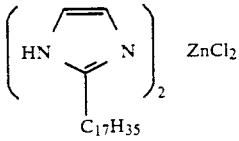

[I-5]

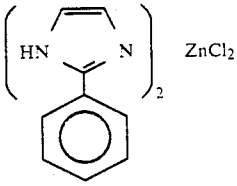

-continued

[I-6]

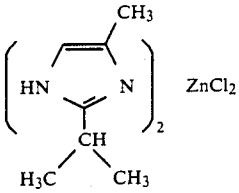

[I-7]

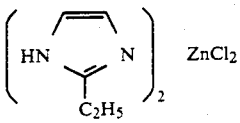

[I-8]

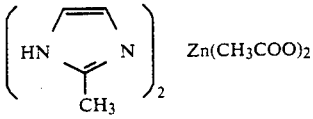

[I-9]

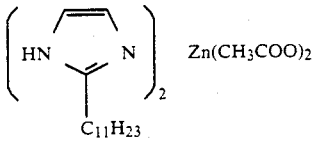

[I-10]

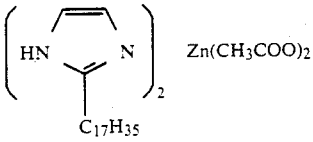

[I-11]

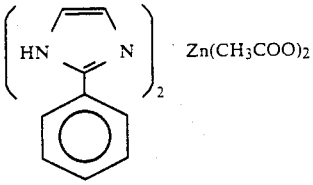

[I-12]

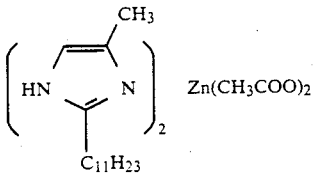

[I-13]

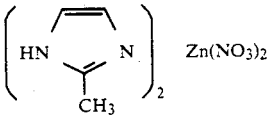

[I-14]

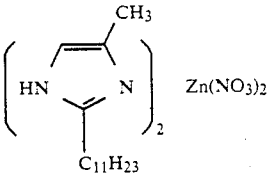

-continued
[I-15]
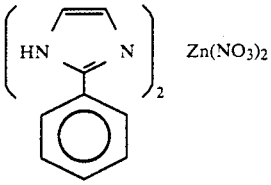
[I-16]
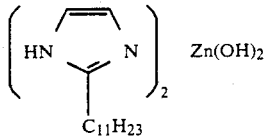
[I-17]
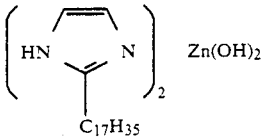
[I-18]
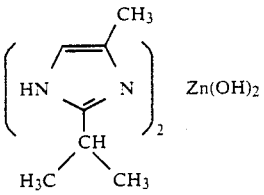
[I-19]
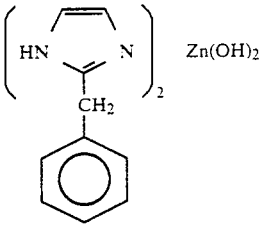
[I-20]
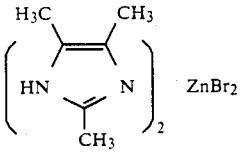
[I-21]
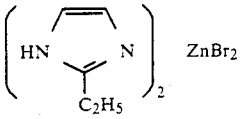
[I-22]
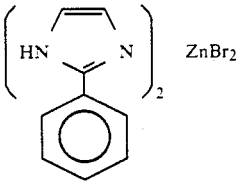
-continued
[I-23]
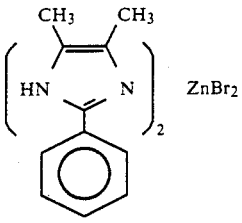
[I-24]
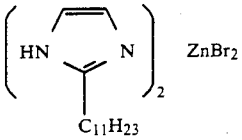
[I-25]
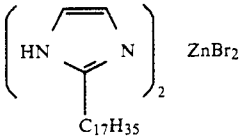
[I-26]
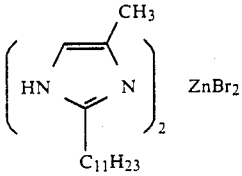
[I-27]
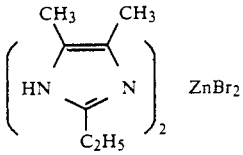
[I-28]
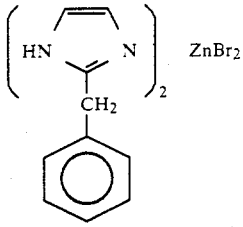
[I-29]
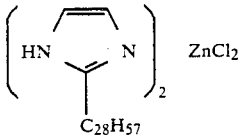
[I-30]
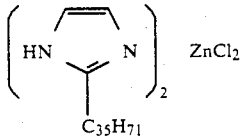
[I-31]
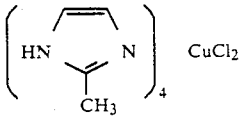

-continued
[I-32]
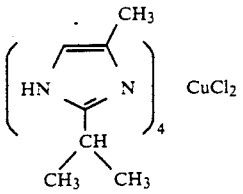
[I-33]
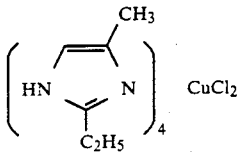
[I-34]
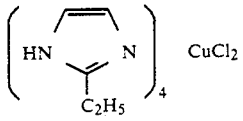
[I-35]
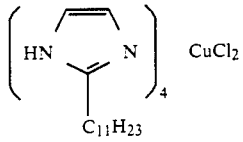
[I-36]
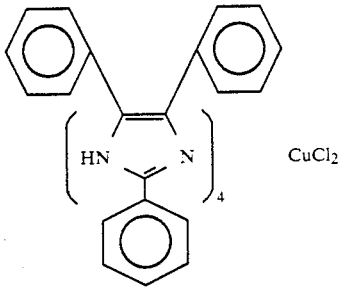
[I-37]
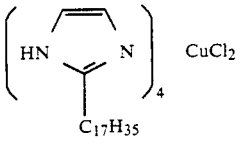
[I-38]
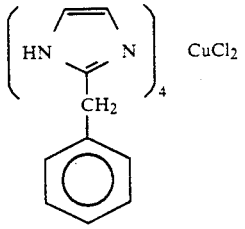
[I-39]
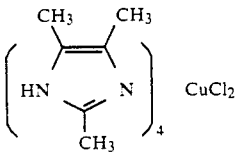
-continued
[I-40]
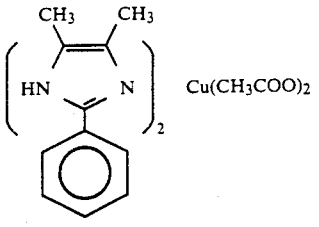
[I-41]
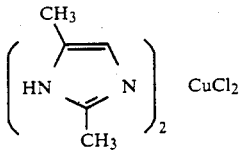
[I-42]
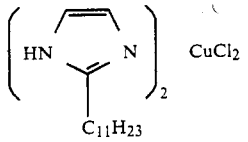
[I-43]
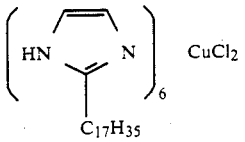
[I-44]
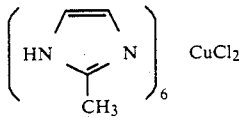
[I-45]
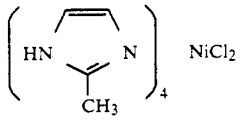
[I-46]
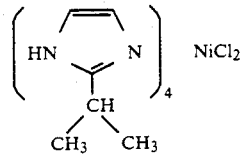
[I-47]
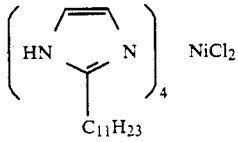
[I-48]
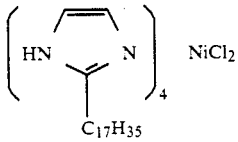

-continued
[I-49]
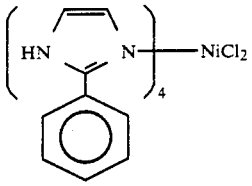
[I-50]
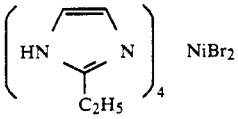
[I-51]
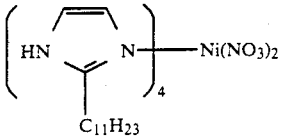
[I-52]
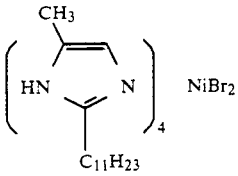
[I-53]
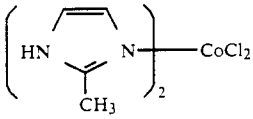
[I-54]
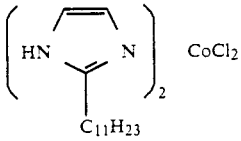
[I-55]
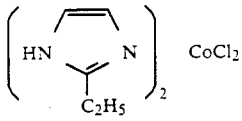
[I-56]
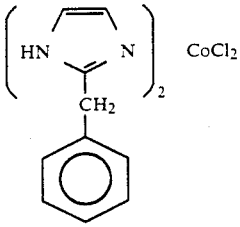
[I-57]
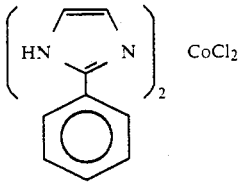
-continued
[I-58]
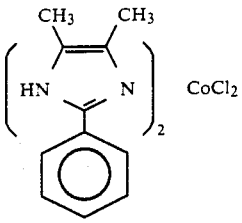
[I-59]
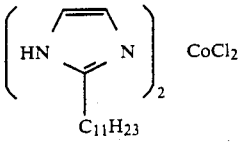
[I-60]
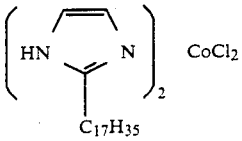
[I-61]
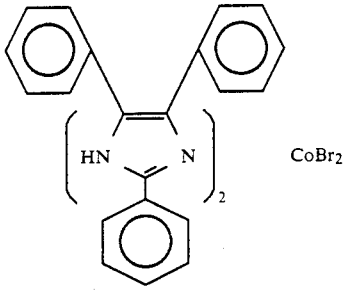
[I-62]
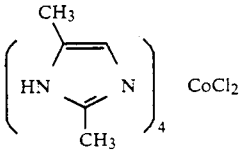
[I-63]
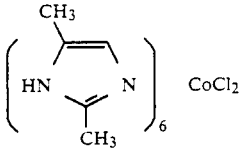
[I-64]
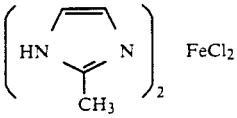
[I-65]
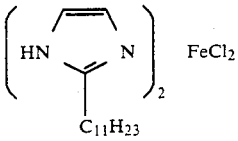
[I-66]
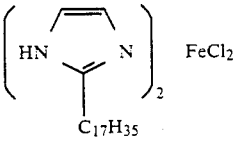

-continued

[I-67]

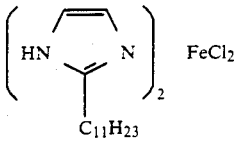

[I-68]

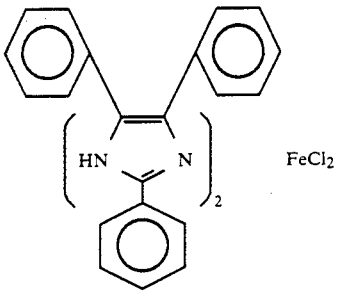

[I-69]

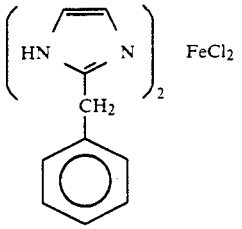

[I-70]

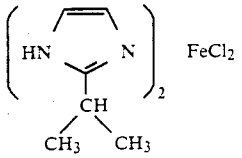

[I-71]

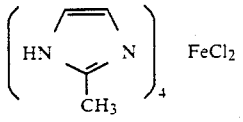

[I-72]

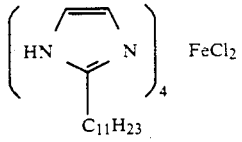

[I-73]

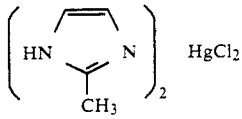

[I-74]

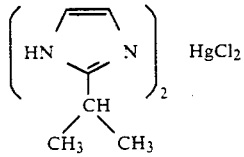

[I-75]

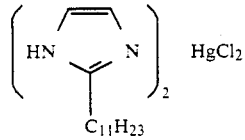

-continued

[I-76]

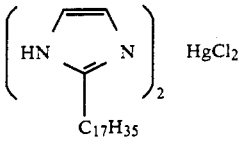

[I-77]

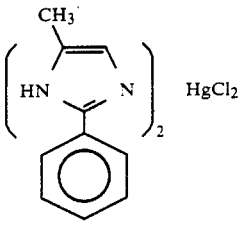

[I-78]

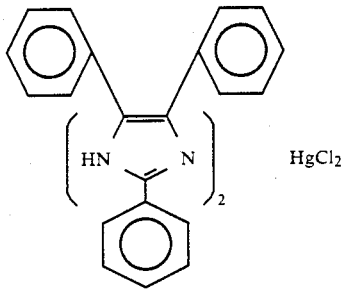

[I-79]

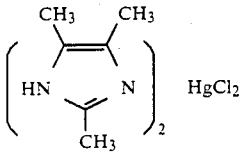

[I-80]

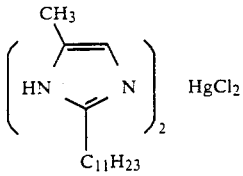

In the general formula [II], $R_4$ is a $C_1$–$C_{35}$ alkyl group (which may be branched), an aralkyl group such as benzyl and phenethyl, or an aryl group such as phenyl.

In general formula [II], $R_5$ and $R_6$ are independently a hydrogen atom, a $C_1$–$C_{35}$ alkyl group (which may be branched), an aralkyl group such as benzyl or phenethyl or an aryl group such as phenyl.

An imidazole metal compound represented by the general formula [II] may be synthesized by heat-treatment of an imidazole metal complex represented by the general formula [I], or may be also synthesized by dissolving an imidazole compound represented by the general formula [ii] below and an metal salt represented by the formula $MX_2$ in a solvent such as ethanol, acetone or the like to react them at a refluxing temperature for a long time.

[ii]

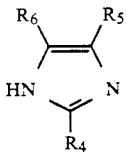

wherein $R_4$, $R_5$ and $R_6$ are the same as those of the general formula [II].
An imidazole metal compound of the present invention represented by the general formula [II] is shown below, but they are shown with no significance in restricting the embodiment.
[II-1]
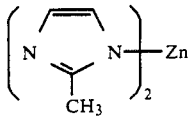
[II-2]
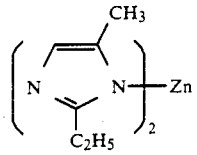
[II-3]
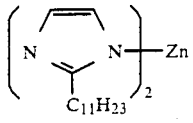
[II-4]
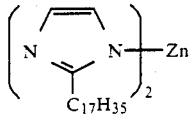
[II-5]
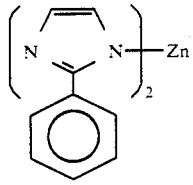
[II-6]
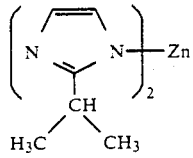
[II-7]
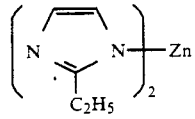
[II-8]
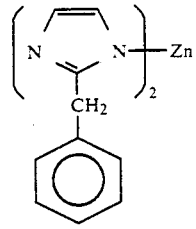
[II-9]
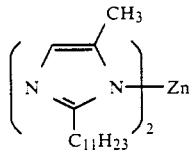
-continued
[II-10]
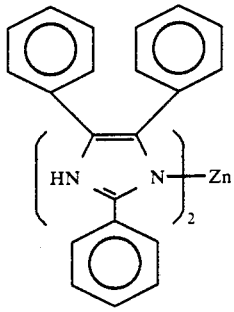
[II-11]
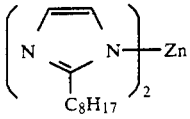
[II-12]
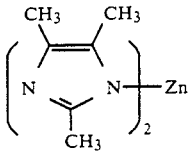
[II-13]
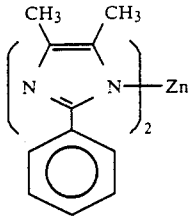
[II-14]
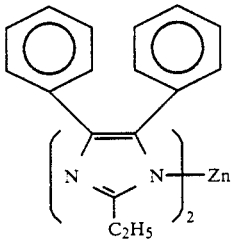
[II-15]
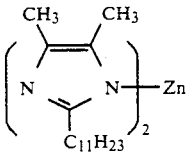
[II-16]
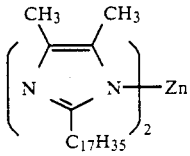

-continued
[II-17]
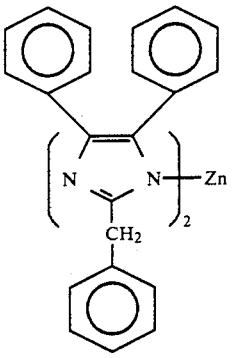
[II-18]
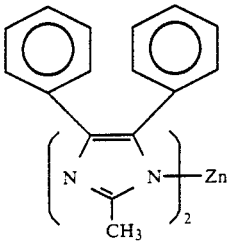
[II-19]
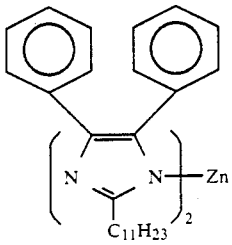
[II-20]
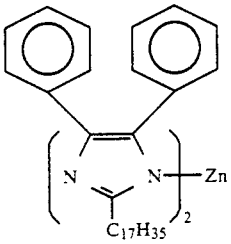
[II-21]
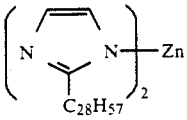
[II-22]
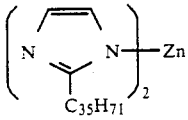
[II-23]
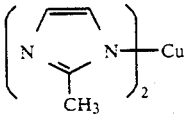
-continued
[II-24]
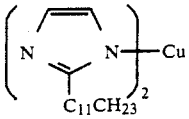
[II-25]
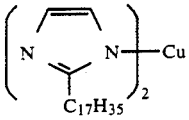
[II-26]
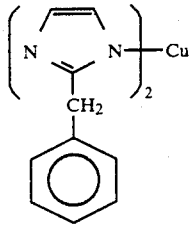
[II-27]
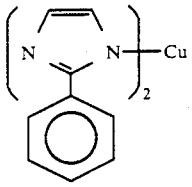
[II-28]
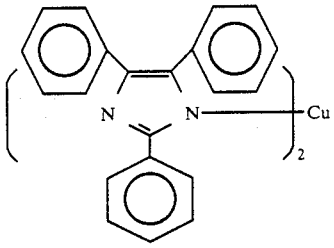
[II-29]
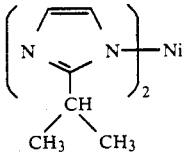
[II-30]
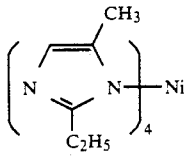
[II-31]
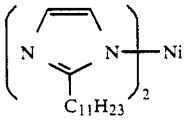

-continued
[II-32]
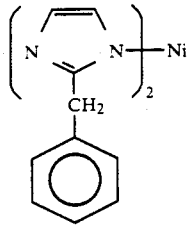
[II-33]
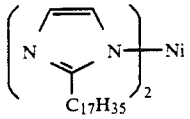
[II-34]
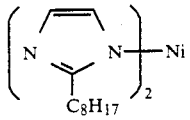
[II-35]
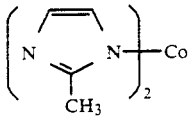
[II-36]
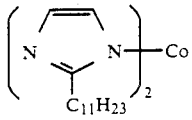
[II-37]
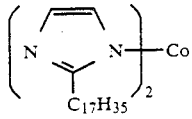
[II-38]
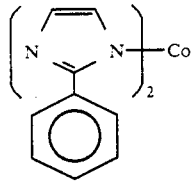
[II-39]
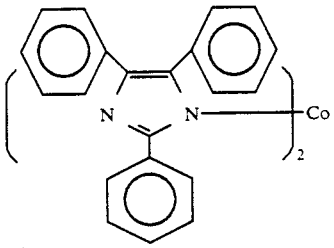
[II-40]
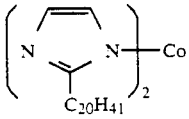
-continued
[II-41]
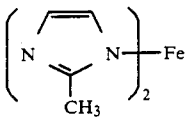
[II-42]
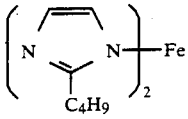
[II-43]
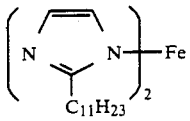
[II-44]
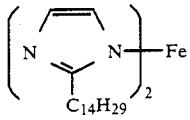
[II-45]
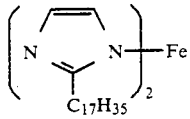
[II-46]
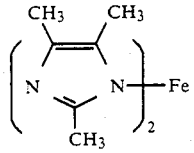
[II-47]
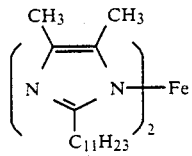
[II-48]
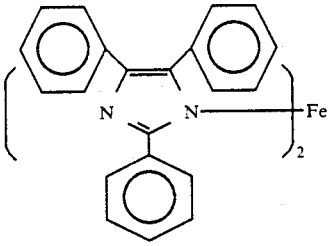
[II-49]
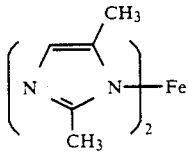
[II-50]
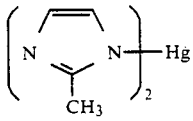

-continued

[II-51]

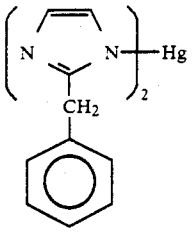

[II-52]

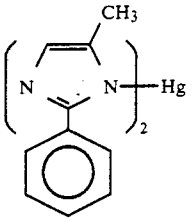

[II-53]

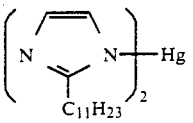

[II-54]

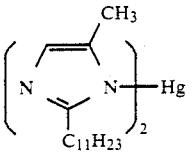

[II-55]

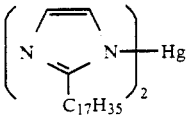

[II-56]

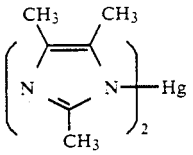

[II-57]

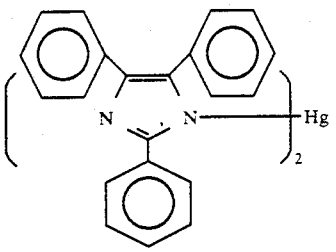

[II-58]

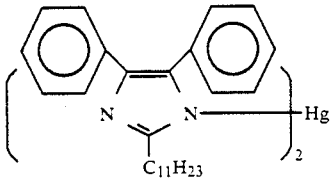

An imidazole compound represent by the general formula [III] is selected from the group consisting of imidazole derivatives represented by the general formula [VII] below;

[VII]

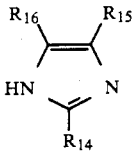

wherein $R_{14}$ is a $C_8$–$C_{30}$ alkyl group; $R_{15}$ and $R_{16}$ are independently a hydrogen atom, a lower alkyl group, an aralkyl group, or an aryl group; an imidazole derivative represented by the general formula [VIII] below;

[VIII]

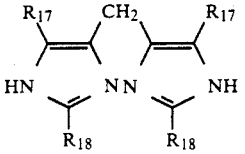

wherein $R_{17}$ and $R_{18}$ are independently an hydrogen atom, an alkyl group, an aralkyl group or an aryl group; an imidazole derivative represented by the general formula [IX] below;

[IX]

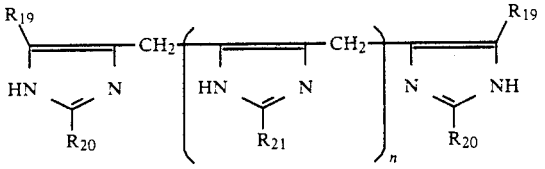

wherein $R_{19}$, $R_{20}$ and $R_{21}$ are independently a hydrogen atom an alkyl group or an aryl group; n is an integer of 1 or more; an imidazole derivative represented by the general formula [X] below;

[X]

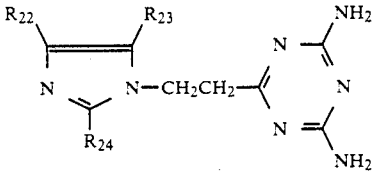

wherein $R_{22}$ and $R_{23}$ are respectively a hydrogen atom, an alkyl group, an aralkyl group or an aryl group which may have a substituent; $R_{24}$ is an alkyl group, an aralkyl group or an aryl group each of which may have a substituent; and an imidazole derivative represented by the general formula [XI] below;

[XI]

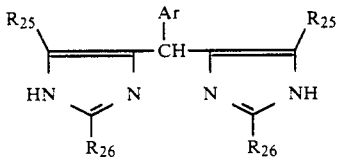

wherein $R_{25}$ is an alkyl group; $R_{26}$ is an alkyl group, an aralkyl group or an aryl group, each of which may have a substituent; Ar is an aryl group or heterocyclic group, each of which may have a substituent.

In the general formula [VII];

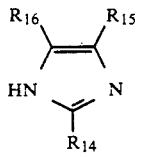

[VII]

wherein $R_{14}$ is a $C_8$–$C_{30}$ alkyl group; $R_{15}$ and $R_{16}$ are independently a hydrogen atom, a lower alkyl group, an aralkyl group, or an aryl group; an imidazole derivative represented by the general formula [VII] is per se known, and can be synthesized according to a generally known method, for example, described in Japanese Patent Publication No. 1548/1967.

An imidazole derivative represented by the general formula VII is shown below, but they are shown with no significance in restricting the embodiment;

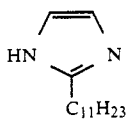

[VII-1]

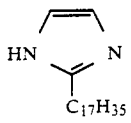

[VII-2]

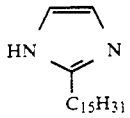

[VII-3]

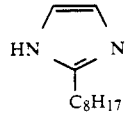

[VII-4]

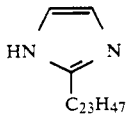

[VII-5]

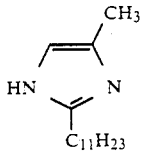

[VII-6]

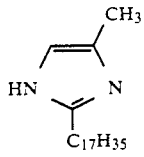

[VII-7]

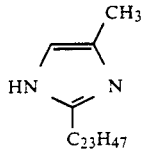

[VII-8]

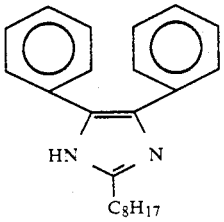

[VII-9]

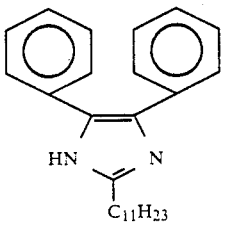

[VII-10]

-continued

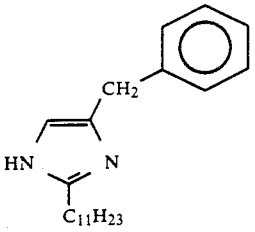

[VII-11]

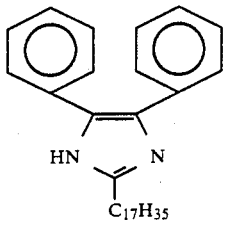

[VII-12]

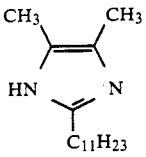

[VII-13]

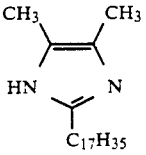

[VII-14]

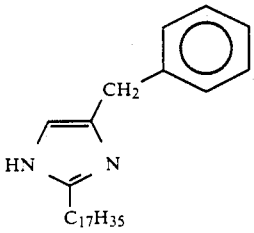

[VII-15]

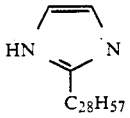

[VII-16]

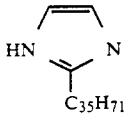

[VII-17]

In the general formula VIII;

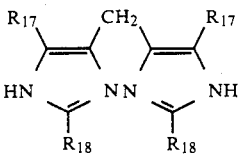

[VIII]

$R_{17}$ and $R_{18}$ are respectively a hydrogen atom, a $C_1$–$C_{35}$ alkyl group (which may be branched), an aralkyl group such as benzyl or phenethyl, or an aryl group such as phenyl.

An imidazole derivative represented by the general formula [VIII] can be synthesized easily by reacting an imidazole compound represented by the general formula [A] with formaldehyde directly or in the presence of an inorganic catalyst of a strong base in an adequate solvent as shown by reaction formula below.

A preferable solvent used in the synthesis is an alcohol such as methanol, ethanol, isopropanol, ethylene glycol, and ethylene glycol monoalkyl ether and the like. Reaction temperature depends on a kind of a solvent but being in general within the range of 80°–200° C.

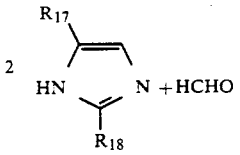
[A]
a compound represented by the general formula [VIII]
An imidazole derivative represented by the general formula VIII is shown below, but they are shown with no significance in restricting the embodiment.
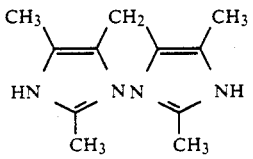
[VIII-1]
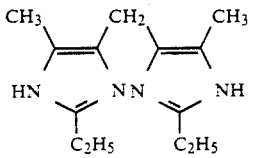
[VIII-2]
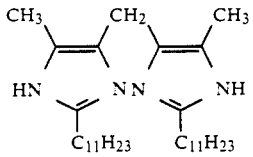
[VIII-3]
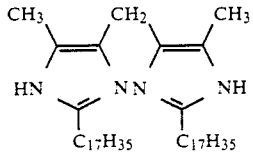
[VIII-4]
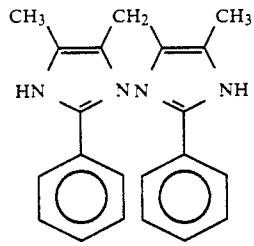
[VIII-5]
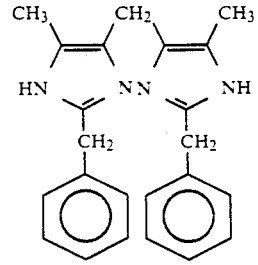
[VIII-6]
-continued
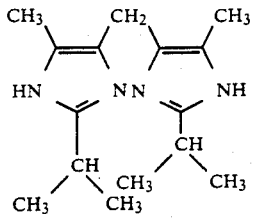
[VIII-7]
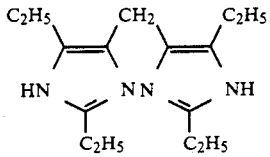
[VIII-8]
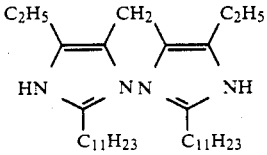
[VIII-9]
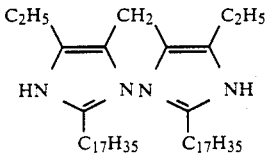
[VIII-10]
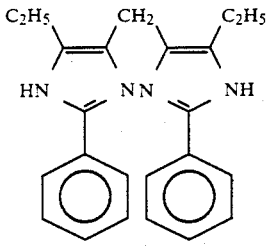
[VIII-11]
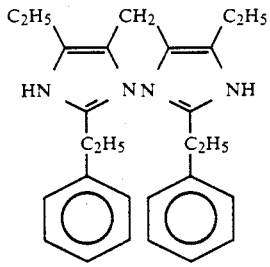
[VIII-12]
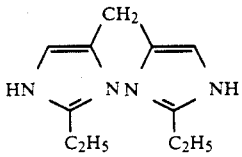
[VIII-13]
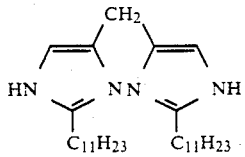
[VIII-14]

-continued

[VIII-15]

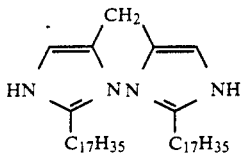

[VIII-16]

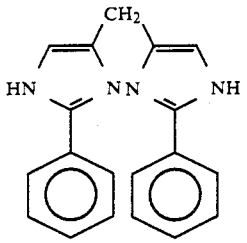

[VIII-17]

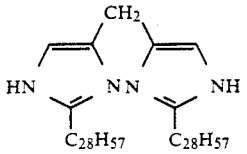

[VIII-18]

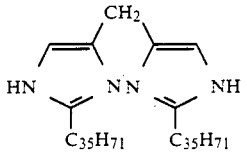

In general formula [IX]

[IX]

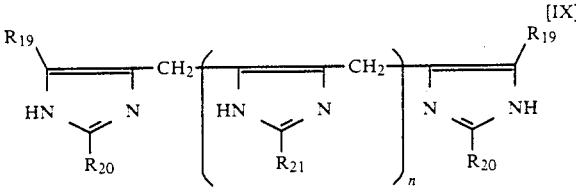

$R_{19}$, $R_{20}$ and $R_{21}$ are independently a hydrogen atom, a $C_1$–$C_{35}$ alkyl group (which may be branched), an aralkyl group such as benzyl and phenethyl, or an aryl group such as phenyl; n is an integer of 1 or more, preferably an integer of 1–50.

An imidazole derivative represented by the general formula [IX] can be synthesized easily by reacting an imidazole compound represented by the general formula [B] and an imidazole compound represented by the general formula [C] with formaldehyde directly or in the presence of an inorganic catalyst of a strong base in an adequate solvent as shown by reaction formula below.

A preferable solvent used in the synthesis is an alcohol such as methanol, ethanol, isopropanol, ethylene glycol or ethylene glycol monoalkyl ether. A reaction temperature depends on a kind of a solvent but being in general within the range of 80°–200° C.

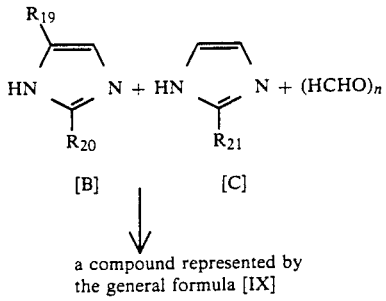

An imidazole derivative represented by the general formula [IX] is shown below, but they are shown with no significance in restricting the embodiment.

[IX-1]

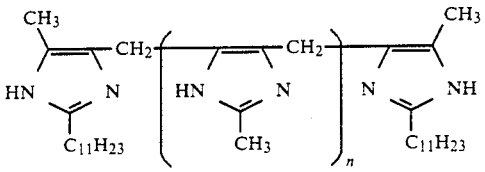

[IX-2]

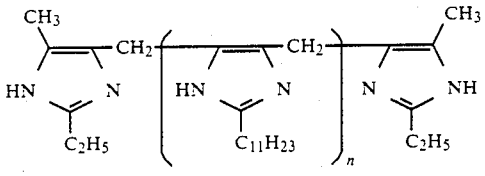

[IX-3]

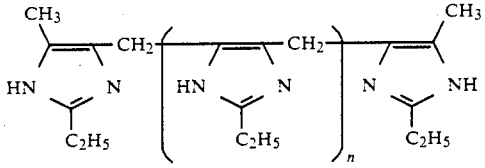

[IX-4]

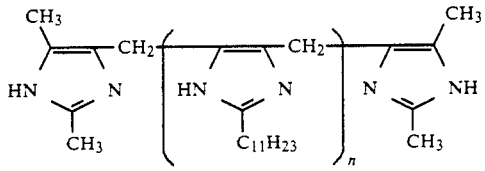

[IX-5]

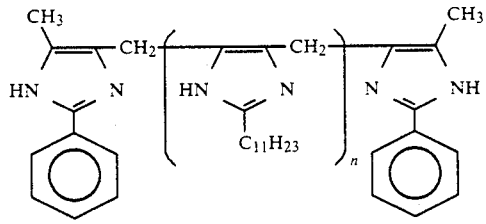

-continued

[IX-6]

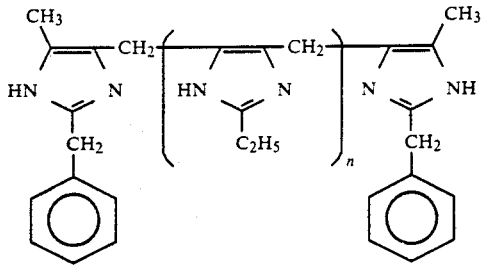

[IX-7]

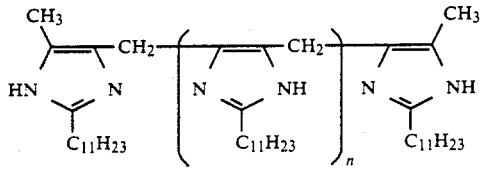

[IX-8]

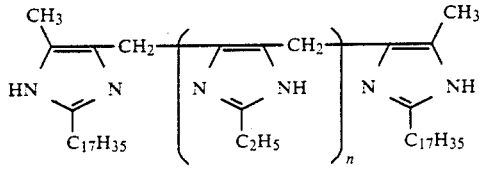

[IX-9]

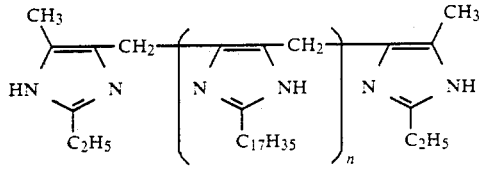

[IX-10]

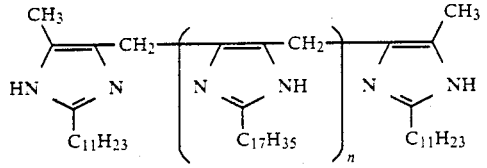

[IX-11]

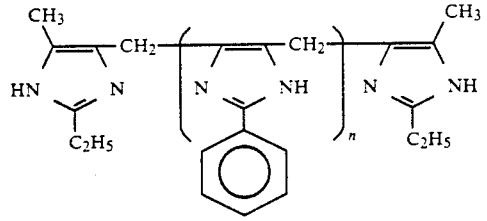

[IX-12]

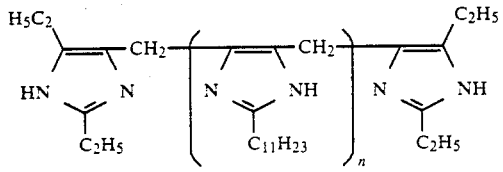

[IX-13]

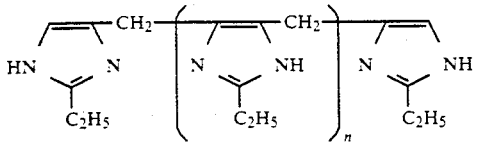

-continued

[IX-14]

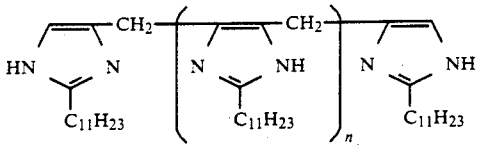

[IX-15]

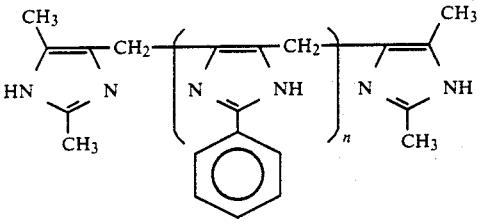

[IX-16]

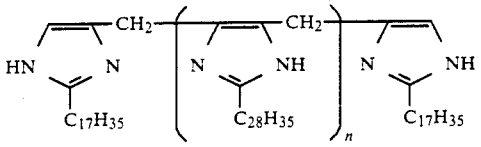

[IX-17]

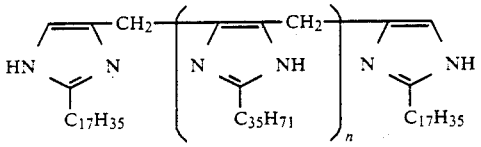

In the general formula [x];

[X]

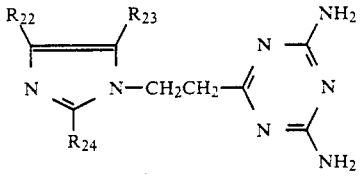

$R_{22}$ and $R_{23}$ are independently a hydrogen atom, a $C_1$–$C_{35}$ alkyl group (which may be branched), an aralkyl such as benzyl and phenethyl, or an aryl group such as phenyl, each of which may have a substituent.

$R_{24}$ is a $C_1$–$C_{35}$ alkyl group (which may be branched), an aralkyl group such as benzyl and phenethyl, or an aryl group such as phenyl, each of which may have a substituent.

An imidazole derivative represented by the general formula [X] can be synthesized as shown in the reaction formula below;

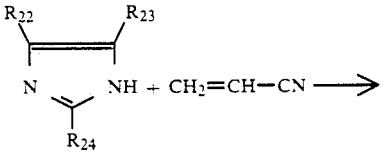

[D]

-continued

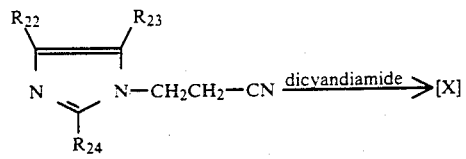

[E]

FIrst, an imidazole compound of the general formula [D] is reacted with acrylonitrile to obtain a compound represented by the formula [E], and then the compound of the general formula [E] is reacted with dicyandiamide.

Some of imidazole derivatives of the formula [X] are known as curing agents for expoxy resin.

An imidazole derivative represented by the general formula [X] is shown below; but they are shown with no significance in restricting the embodiment.

[X-1]

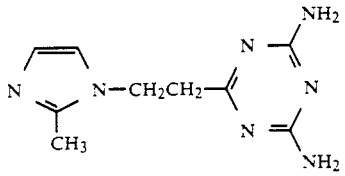

[X-2]

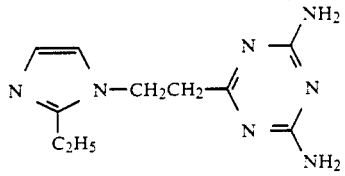

[X-3]

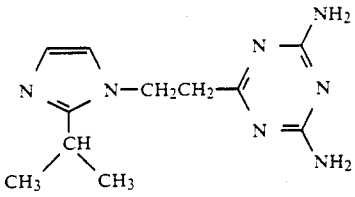

[X-4]

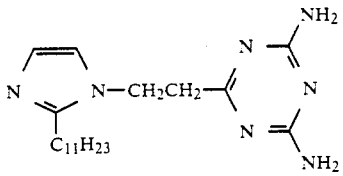

[X-5]

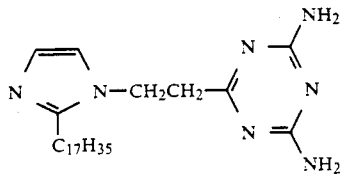

[X-6]

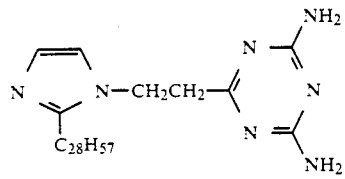

-continued

[X-7]

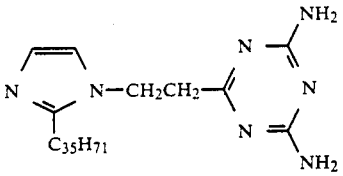

[X-8]

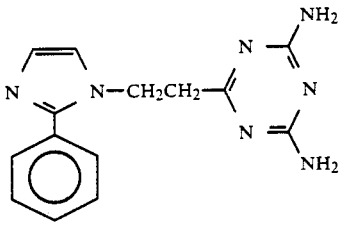

[X-9]

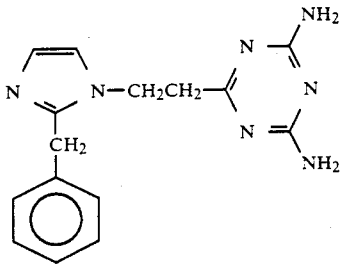

[X-10]

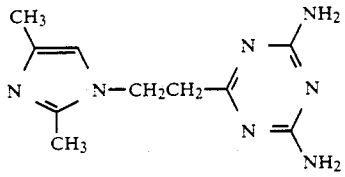

[X-11]

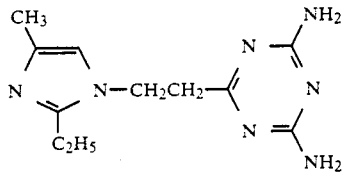

[X-12]

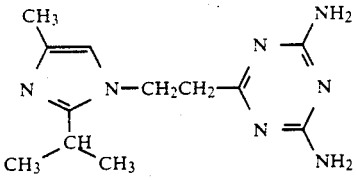

[X-13]

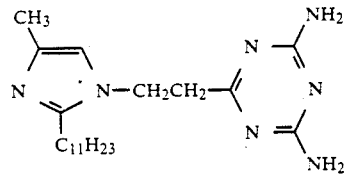

[X-14]

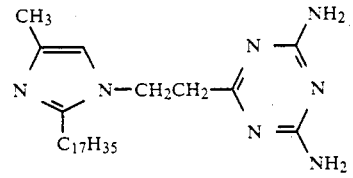

-continued

[X-15]

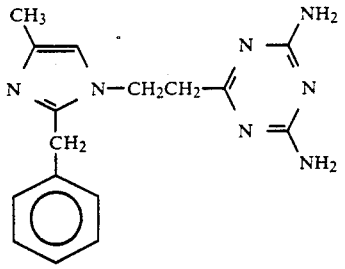

[X-16]

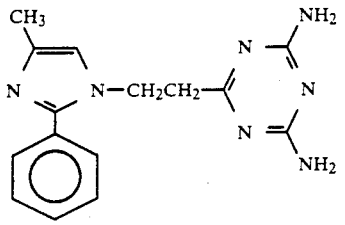

[X-17]

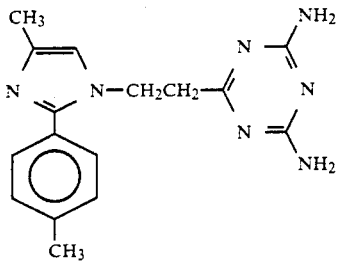

[X-18]

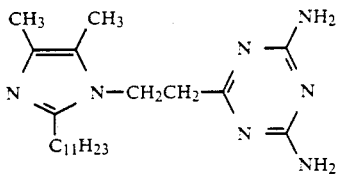

[X-19]

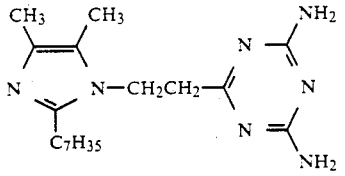

[X-20]

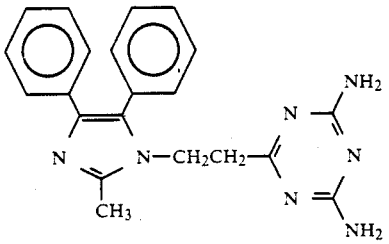

[X-21]

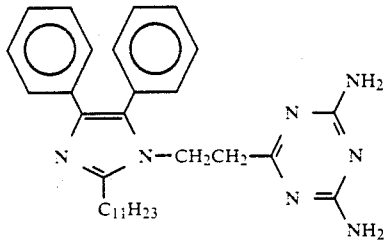

-continued

[X-22]

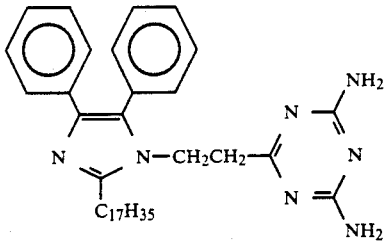

[X-23]

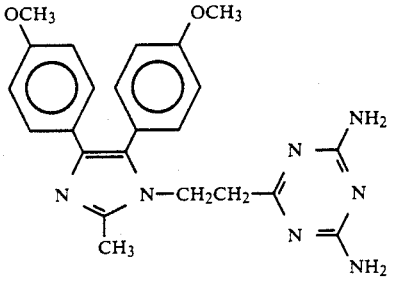

[X-24]

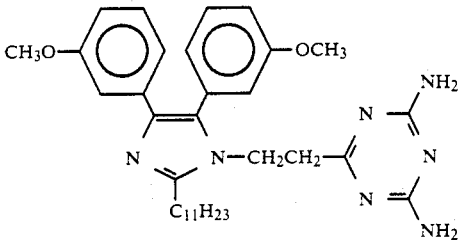

[X-25]

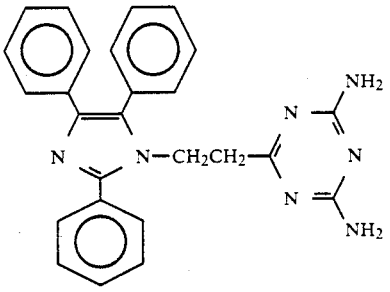

In the general formula [XI];

[XI]

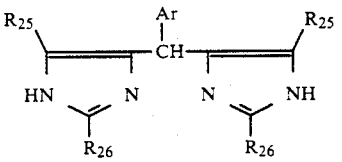

$R_{26}$ is a $C_1$–$C_{35}$ alkyl group (which may be branched), and aralkyl group such as benzyl and phenethyl, or an aryl group such as phenyl; $R_{25}$ is a $C_1$–$C_{35}$ alkyl group (which may be branched); Ar is an aryl group such as phenyl, napthyl, or a heterocyclic group such as furan, thiophene and carbazole.

An imidazole derivative represented by the general formula [XI] can be synthesized by reacting an imidazole compound of the general formula [F] with an imidazole compound of the general formula [G] in the presence of an alkali catalyst.

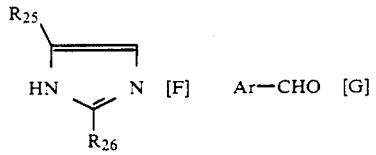

The reaction does not always require a solvent, but, if necessary, preferable solvents is an alcohol such as methanol or ethanol.

The reaction is carried out at a reaction temperature for 1–2 hours.

Preferable alkali catalysts are alkali hydroxides, particularly preferable ones are sodium hydroxide and potassium hydroxide.

An imidazole derivative represented by the general formula [XI] is shown below, but they are shown with no significance in restricting the embodiment.

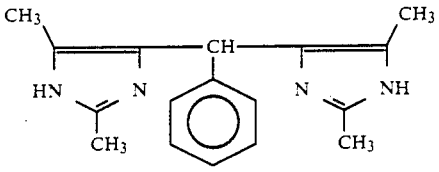

[XI-1]

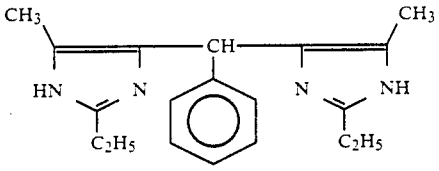

[XI-2]

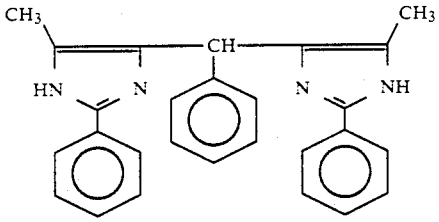

[XI-3]

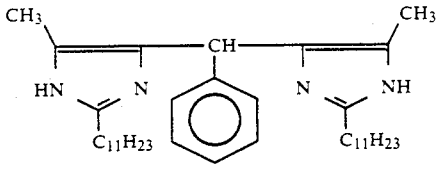

[XI-4]

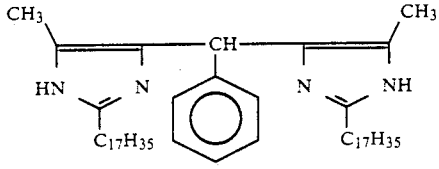

[XI-5]

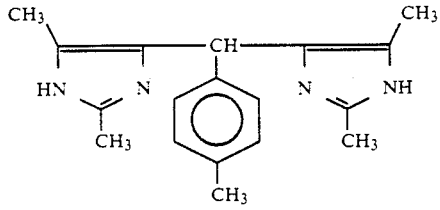

[XI-6]

-continued

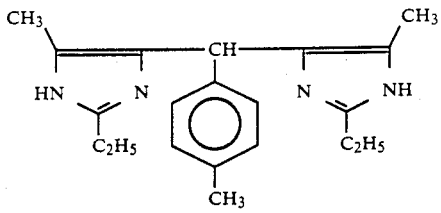

[XI-7]

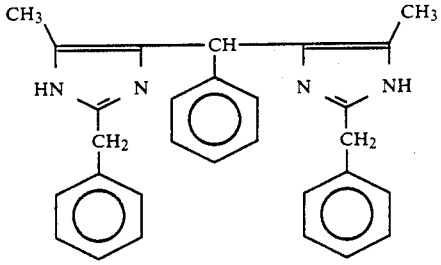

[XI-8]

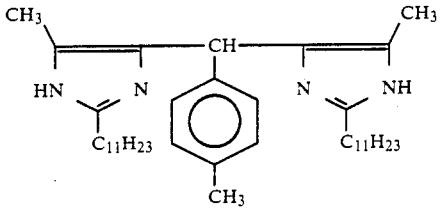

[XI-9]

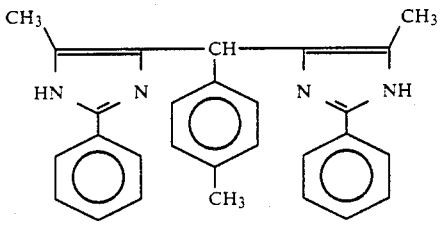

[XI-10]

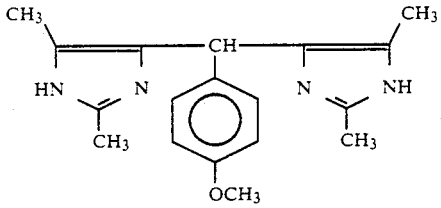

[XI-11]

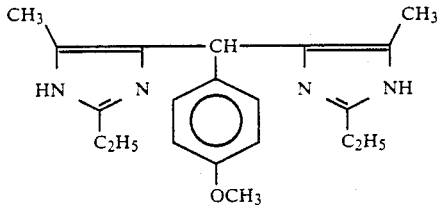

[XI-12]

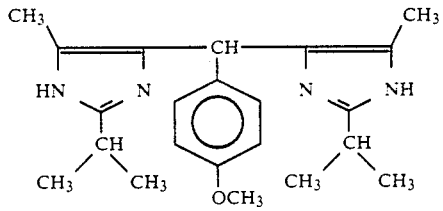

[XI-13]

-continued
[XI-14]
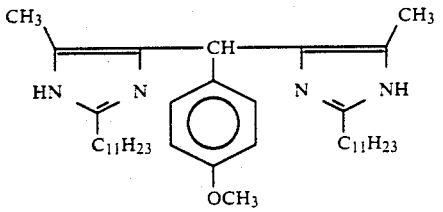
[XI-15]
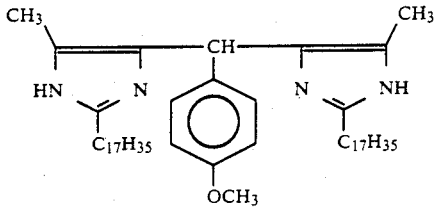
[XI-16]
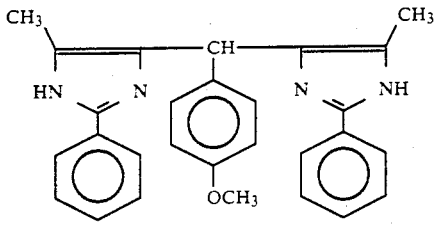
[XI-17]
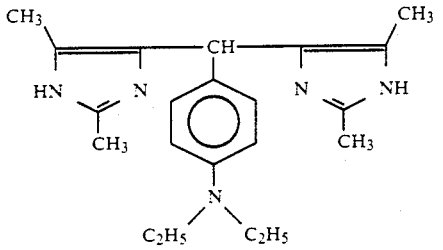
[XI-18]
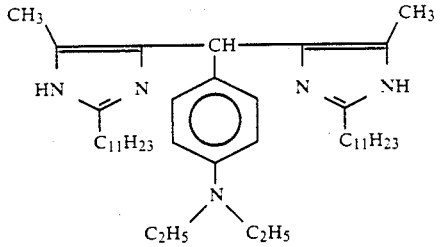
[XI-19]
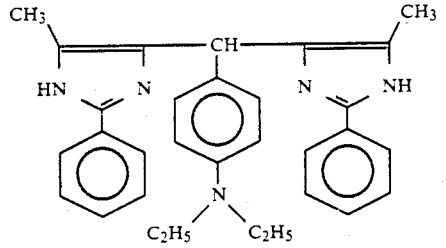
[XI-20]
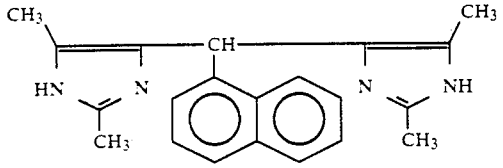
-continued
[XI-21]
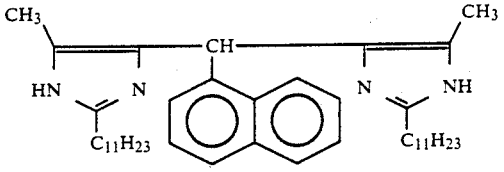
[XI-22]
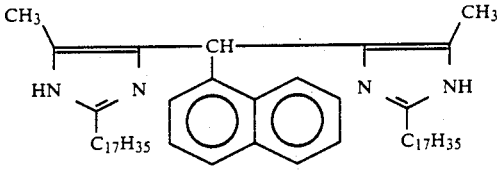
[XI-23]
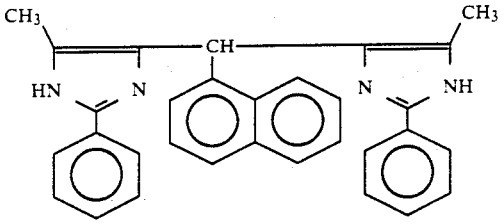
[XI-24]
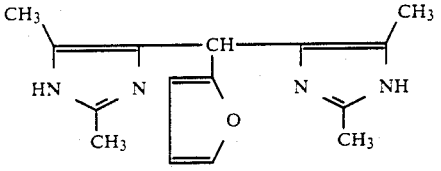
[XI-25]
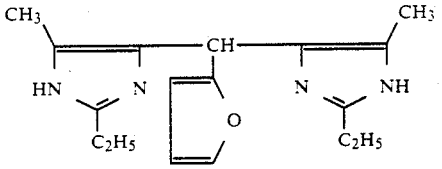
[XI-26]
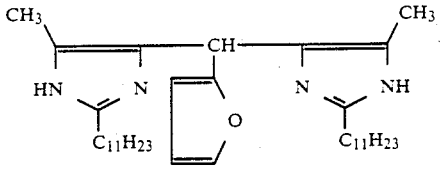
[XI-27]
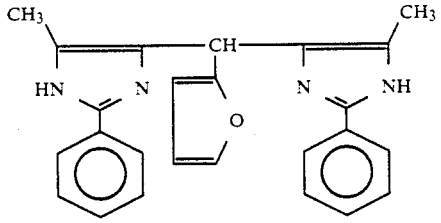
[XI-28]
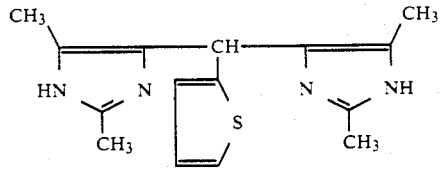

-continued

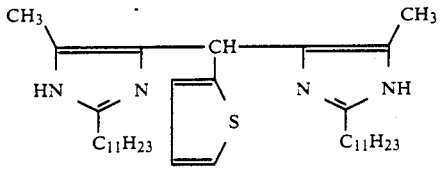

[XI-29]

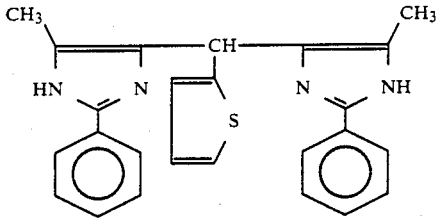

[XI-30]

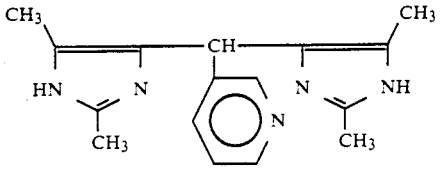

[XI-31]

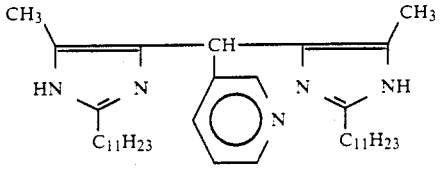

[XI-32]

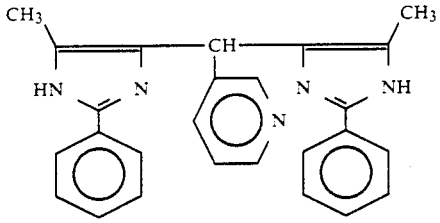

[XI-33]

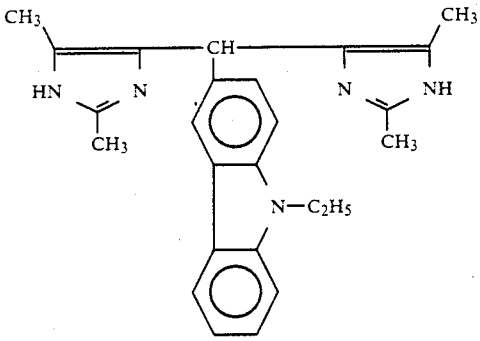

[XI-34]

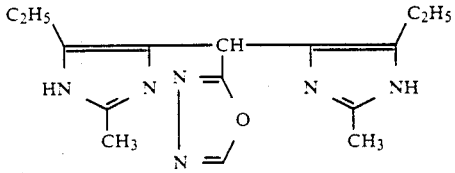

[XI-35]

-continued

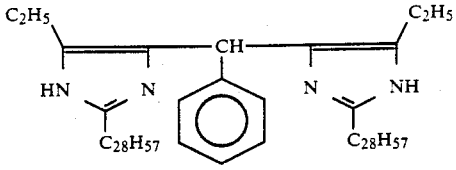

[XI-36]

Charging means functions to charge a toner to a proper level and being exemplified by a blade, a sleeve, a carrier and the like.

When an imidazole compound of the present invention is applied to a blade or a sleeve, the blade or the sleeve is particularly useful for a single-component developing method.

There are known various types of single-component developing methods.

In general, a cylindrical sleeve (a toner transport member) is arranged between a photosensitive drum on the surface of which electrostatic latent images to which a toner is transferred are formed, and a toner container containing a toner for a single-component system. A blade, which plays a part in both levelling a toner and charging a toner, is pressed against a toner transport member. As a toner transport member moves, a thin layer of a toner is formed by a toner-levelling member. At the same time a toner is charged to a level and a polarity necessary for development. Accessively, a toner is provided for a photosensitive drum by being attracted electrostatically by electrostatic latent images to make them visible.

A blade comprises, in general, metals such as phosphor bronze, stainless steel, aluminium and the like, resins such as urethanes, nylons, teflon, silicone resins, polyacetals, polyesters, polyethylenes, polystyrenes, acrylic resins, styrene-acrylic resins, melamines, epoxy resins and the like, synthesized rubbers such as ethylenepropylene rubbers, fluorine rubbers, polyisoprene rubbers and the like, and natural rubber. A blade is pressed against a surface of a sleeve in line contact. A surface of a blade is covered with a resin layer containing an imidazole compound of the present invention. When a blade is made of a resin, the resin may contain an imidazole compound of the present invention.

The limitation is not particularly given to a resin used for the formation of a resin layer containing an imidazole compound on a blade, however examples are given to the one used generally as a binder in a hard coating art, for example, a thermoplastic resin such as styrene resins, (metha)acrylic resins, olefin resins, amide resins, polycarbonate resins, polyethers, polysulfones, polyesters, silicone resins, polyacetals and the like, a thermosetting resin such as epoxy resins, urea resins, urethane resins and the like, copolymers thereof and resin blenders thereof.

An imidazole compound of the present invention may be dispersed in an alkoxy metal such as Si, Ti, Fe, Co, Al or the like and then a blade may be coated with the resultant dispersion and heat-treated to form a ceramic hard coating layer.

An imidazole compound of the present invention is 10 μm or less, preferably 3 μm or less in particle size in order to disperse it uniformly into a coating layer.

An usage of an imidazole compound of the present invention is 0.01–20 parts by weight, preferably 0.1–10 parts by weight on the basis of 100 parts by weight of a coat resin. Thereby, a toner is charged speedily and stable charge amounts are given to a toner. When a ceramic hard coating layer is formed, the content may be same as above mentioned.

With respect to a coating method, a solution of an imidazole compound of the present invention dissolved or dispersed at a specified amount in a solution of a resin dissolved and/or uniformly dispersed in an adequate solvent is coated for drying onto a blade by a known method such as a spray method, a dipping method, a blade method so that an obtained layer is 0.1-500 μm, preferably 1-200 μm, more preferably 10-100 μm in thickness. If the thickness is less than 0.1 μm, it is difficult to form an uniform coating layer on a surface with uniform thickness. If the thickness is more than 500 μm, it becomes poor in adhesivity of a coating layer to a toner levelling member.

When a ceramic material is used as a coating material, an usually known method such as a heat depositing method, a sputtering method, an ion-plating method, a chemical depositing method, a sol-gel method, a spray method, a dipping method, a blade method or the like may be used. A layer thickness may be same as a resin layer as above mentioned, more desirably 0.5-10 μm.

A sleeve as a toner transport member constitutes outer periphery of an electrically conductive and cylindrical roller made of aluminium, phosphor bronze, stainless steel, iron or the like. A cylindrical rubber with electrical conductivity, a cylindrical thin layer made of an electrical conductive metal (Ni, Al, Ti, Cr, Mo, W, brass, stainless steel, Co-$Al_2O_3$, Pb-$TiO_2$, Pb, Tic and the like), a cylindrical resin film (polycarbonate, nylon, polyester, polyethylene, polyurethane, fluorine resin) and the like may be conventionally applied to a sleeve.

A sleeve of the present invention is obtained by coating a conventional toner transport member with a resin layer containing an imidazole compound of the present invention.

When a conventional toner transport member is made of a resin, an imidazole compound of the present invention is incorporated into the toner transport member to obtain a sleeve of the present invention. A content of a imidazole compound and a coating method are same as those described with respect to a blade.

It is advantageous for more advanced improvement of electrification build-up properties of a toner and the stability of a toner charging amount that irregularities (protuberances and hollows) are formed on a surface of a blade or a sleeve. Such irregularities are naturally formed by addition of an imidazole compound. However, in order to form irregularities intentionally, various kinds of fine particles may be incorporated together with an imidazole compound.

Such fine particles may be used taking the charging polarity of the particles measured by a blow-off method into consideration.

Inorganic fine particles, organic fine particles and a mixture thereof may be used.

Fine particles are exemplified by benzoguanamine resin particles, melamine resin particles, glass beads, nylon beads, epoxy resins, phenol resins, amino-acrylic resins, fluorine resins, silicone resins, polyester resins, polyethylene resins, fluorine-acrylic resins, and inorganic or organic fillers. Those particles may be subjected to a hydrophobic treatment with a coupling agent or the like.

Surface roughness is preferably within the range of 1/10-8/10 to a average particle size of toner, usually 0.1-10 μm, preferably 1-5 μm. If the surface roughness is more than 10 μm, toner particles go into hollows formed on a surface of a toner transport member and it becomes difficult to charge a toner uniformly because the contact possibility of a toner with a toner levelling member decreases. If the surface roughness is less than 0.1 μm, the effects such as uniform chargeability of a toner and the uniform layer formation caused by surface irregularities decrease.

The surface roughness in the present invention means ten-points average-roughness (Rz) as described below.

The ten-points average-roughness (Rz) means the defference between an average value of five heights of most-highest mountain tops and an average value of five lowest heights of most-lowest valley bottoms within some constant range of a surface sectional curve. The height of a mountain top or a valley bottom is measured lengthwise from a line which is parallel to an average line and does not cross a surface sectional curve. The ten-points average roughness is represented by "μm".

The ten-points average roughness may be measured by, for example, a surface roughness and shape measuring apparatus of a tracer method, Surfcom 550 A (made by Tokyo Seimitsu K.K.).

Figure 2:
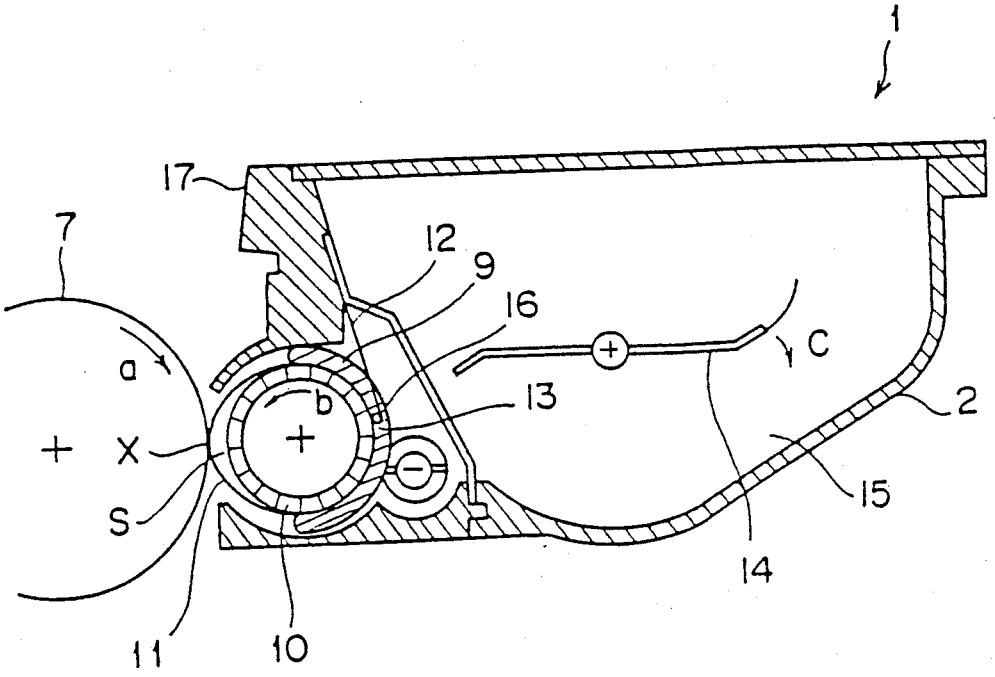

A schematic view of a developing machine equipped with a blade and a sleeve of the present invention is shown in FIG. 1 and FIG. 2.

FIG. 1 is a cross-sectional view of a developing device (1).

The developing device (1) adjoins a photoreceptor drum (7) driven rotatably in a direction as shown by an arrow (a).

A rotatably arranged developing roller (3) is composed of an electrically conductive material such as aluminium or the like and a sleeve (8) covering the electrically conductive roller. The sleeve (8) is formed cylindrically and mounted firmly on the electrically conductive roller. A developing bias voltage is applied to the roller. Therefore, the sleeve has an adequate electrical conductivity. A sleeve of the present invention as described above is applied in FIG. 1. Further, it is desirable that a surface of a sleeve may be made irregular.

The developing roller (3) is supported rotatably and connected to a driving source (not shown). The surface of the sleeve (8) is contacted with the photoreceptor drum (7). A toner levelling blade (4) is pressed against the sleeve at a diagonally upper portion of the rear side of the roller. Charging means containing an imidazole compound is applied to the toner levelling blade (4). It is preferable that the blade is provided with irregularities.

Charging means may be applied to both the blade (4) and the sleeve (8) or either the blade (4) or the sleeve (8).

An agitator (5) rotates in a direction as shown by the arrow (c) to provide a surface of the developing roller (3) with a toner. A thin layer of the toner is formed uniformly on the surface of the sleeve when the toner passed through between the developing roller (3) and the blade (4), at the same time, the toner is charged uniformly.

FIG. 2 shows another example of a developing device.

The developing device (1) adjoins a photoreceptor drum (7) driven rotatably in a direction as shown by an arrow (a).

A rotatably arranged developing roller (10) is composed of an electrically conductive material such as aluminium or the like and a conductive elastic material such as rubber, plastic or the like formed on the electrically conductive material. A developing bias voltage is applied to the roller.

A filmy member (11) is formed cylindrically and has a peripheral length slightly longer than that of the developing roller (10) so as to be loosely mounted. The filmy member (11) contains an imidazole compound or being covered with a resin coating layer containing an imidazole compound. The developing roller (10) is supported rotatably and connected to a driving source (not shown).

A sleeve guide (9) is interposed at both end portions of the roller (10) so that the filmy member (11) may be brought into close contact with the external surface of the roller (10).

Accordingly, the filmy member (11) is brought into close contact with the external surface of the roller (10), and a space (S) is formed between the filmy member (11) and the roller (10) because an excessive peripheral portion of the filmy member (11) having the longer periphery than that of the roller (10) is collected at the open side of the free guides. Consequently, the protruding portion of the filmy member (11) covering the space S is brought into contact, at its external surface, with the peripheral surface of the photoreceptor drum (7).

It is to be noted that the sleeve guide (9), the roller (10) and the filmy member (11) are selected to satisfy a relation of $\mu_1 > \mu_2$, where a dynamic coefficient of friction between the external surface of the roller (10) and the internal surface of the filmy member (11) is $\mu_1$ and that between the external surface of the filmy member (11) and the sleeve guide (9) is $\mu_2$. Accordingly, when the developing roller (10) is caused to rotate in a direction as shown by an arrow (b), the filmy member (11) rotates together with the rotation of the roller (10).

A blade (12) having a round bar (16) at its end is mounted on the rear side of a support member (17) provided above the roller (10) and the round bar is pressed against the filmy member (11) at a diagonally upper portion of the rear side of the roller (10).

The round bar (16) at the end of the blade (12) contains an imidazole compound or being covered metallic bar with a resin coating layer containing an imidazole compound.

Charging means may be applied to both a filmy member (11) and a round bar (16) or either the filmy member (11) or the round bar (16).

A toner storing compartment (15) is formed at a rear portion of a casing (2) and is internally provided with an agitator (14) disposed rotatably in a direction as shown by an arrow (c). The agitator (14) functions to agitate a toner stored in the toner storing compartment (15) in a direction as shown by the arrow (c) for the prevention of blocking thereof. A non-magnetic toner or a single component toner may be used.

The operation of the developing device (1) having the above described constitution will be explained hereinafter, representing the device shown in FIG. 1.

On condition that the roller (10) and the agitator (14) are caused to rotate by a driving source (not shown) respectively in directions as shown by the arrows (b) and (c), the toner accommodates within the toner storing compartment (15) is forcibly moved with stirring in a direction shown by the arrow (c) by the agitator (14).

Meanwhile, the filmy member (11) is driven to rotate in a direction as shown by the arrow (b) by the frictional force exerting between it and the roller (10), with the result that the toner in contact with the filmy member (11) is transported in a direction of rotation of the filmy member (11) by the action of electrostatic force. When the toner is caught in a wedge-shaped taken-in portion (13) formed between the filmy member (11) and the round bar (16) and reaches a pressure portion where the blade (12) is pressed against the filmy member (11), the toner is spread uniformly in the form of a thin layer on the surface of the filmy member (11) and tribo-charged.

When the toner held on the filmy member (11) under the influence of the electrostatic force reaches a developing region X confronting the photoreceptor drum (7) in compliance with the movement of the filmy member (11) following the roller (10), the toner is caused to adhere to an electrostatic latent image formed on the surface of the photoreceptor drum (7) to form a toner image in accordance with a voltage difference between a surface voltage of the photoreceptor drum (7) and the bias voltage applied to the roller (10).

Since the roller (10) in contact with the filmy member (11) is never brought into contact with the photoreceptor drum (7) due to the existence of the space S, the filmy member (11) softly and uniformly contacts with the photoreceptor drum (7) through its suitable nip width so that the latent image formed on the photoreceptor drum (7) may be turned to uniform toner images. A peripheral speed of the photoreceptor drum (7) may be caused to differ from that of the filmy member (11), and the toner image once forced on the photoreceptor drum (7) can never be broken.

The toner having passed the developing region X is successively transported, in compliance with the movement of the filmy member (11), in the direction as shown by the arrow (b).

The toner is provided again on the surface of the filmy member (11) by the force of rotation of the agitator (14). Consequently, a thin layer of a charged toner is uniformly formed again on the surface of the filmy member (11) at the pressure portion of the blade (12), and the aforementioned process is repeated thereafter.

Charging means of the present invention may be applied to a carrier, which is one component of a two-component developer.

Such carriers are not particularly restrictive but usually exemplified by iron particles coated with a resin, ferrite carrier coated with a resin, a binder type carrier prepared by mixing a resin, iron fine particles or ferrite fine particles followed by kneading and grinding them, a coated type carrier prepared by coating a surface of magnetic materials with polymer fine particles, and/or various kinds of fine particles such as organic compound, inorganic compounds, magnetic fine particles and the like, or a surface-modified type carrier.

A imidazole compound represented by the general formula [I], [II] or [III] is incorporated into a resin layer or polymer fine particles. The content of an imidazole compound of the present invention is adjusted according to a type of a carrier or a magnetic material. For example, in case of a binder-type carrier, an imidazole compound of 0.01–20 parts by weight, preferably 0.1–10 parts by weight is used on the basis of 100 parts by weight of a binder resin. If the content is more than 20 parts by weight, the stability charges becomes poor when a copying process is repeated for a long time.

In case of a surface-modified type carrier, or a resin-coated type carrier, an imidazole compound of 0.001–10 parts by weight, preferably 0.01–5 parts by weight is used on the basis of 100 parts by weight of core materials of a carrier.

A carrier may be prepared by a per se known method such that an imidazole compound is contained in a coating layer around a surface of a magnetic material. In embodiment, for example, the formation of a resin coating layer on a core material of a carrier is carried out by blowing a solution of a resin in a solvent against carrier core particles by a spray method or the like followed by drying, or by mixing carrier core materials with polymer fine particles mechanically in a blender mill, a henschell mixer or the like to form a coating layer of fine particles on the surface of core materials of a carrier followed by heating, fusing and solidification.

An imidazole compound may be dissolved and/or dispersed uniformly in a solution of a resin to form a coating layer. A coating layer may be formed mechanochemically with polymer fine particles and an imidazole fine particles. A resin layer is formed and then an imidazole compound may be treated by a mechanochemical method. A concrete apparatus which can carry out the formation method of a carrier as above mentioned is exemplified by an outclave equipped with a stirrer, SPIR-A-FLOW (made by Front Sangyo K.K.), a modifying apparatus of an impact type equipped with a heat-treating means (for example, Nara-Hybridizer (made by Nara Kikai Seisakusho K.K.), Angmill (made by Hosokawa Micron K.K.), Supira-Cota (made by Okada Seiko K.K.) or the like.

PRODUCTION EXAMPLE A OF A COATING LAYER ON THE SURFACE OF A BLADE

An imidazole compound shown in Table 1 of 3 parts by weight was dispersed uniformly in a silicone solution for hard coating Tosguard 510; made by Toshiba silicone K.K.) of 100 parts by weight referred to as solids. The surface of a blade (a type shown in FIG. 1) made of phosphor bronze is coated uniformly with the above obtained dispersion solution by a spraying method. The sprayed dispersion solution was dried with air for 30 minutes and the cured by heat at 150° C. for 1 hour to form a silicone resin coating layer of 5 μm in thickness on the blade. The obtained blade is called Blade A.

PRODUCTION EXAMPLE B OF A COATING LAYER ON THE SURFACE OF A BLADE

An imidazole compound shown in Table 1 of 3 parts by weight was dispersed uniformly in a coating solution containing an acrylic resin of a heat-crosslinking type (Paraloid AT-50; made by Rohm & Haas Inc.,) of 10 parts by weight referred to as solids. The surface of a blade (a type shown in FIG. 2) made of phosphor bronze was coated uniformly with the above obtained dispersion solution by a spraying method. The sprayed dispersion solution was dried with air for 30 minutes and then cured by heat at 120° C. for 1 hour to form an acrylic resin coating layer of 5 μm in thickness on the blade. The obtained blade is called Blade B.

PRODUCTION EXAMPLE C OF A COATING LAYER ON THE SURFACE OF A BLADE

Blade C having a coating layer of polyester resin of 8 μm in thickness was prepared in a manner similar to the production example of Blade A, except that a solution of polyester resin (Bylon 200; made by Toyobo K.K.) in toluene was used as a coating solution.

PRODUCTION EXAMPLE D OF A COATING LAYER ON THE SURFACE OF A BLADE

Blade D having a coating layer of silicone resin of 5 μm in thickness was prepared in a manner similar to the production example of Blade A, except that Nigrosine base EX (made by Orient Kagaku Kogyo K.K.) of 3 parts by weight was used instead of an imidazole compound.

PRODUCTION EXAMPLE A OF A COATING LAYER ON THE SURFACE OF A SLEEVE

An imidazole compound shown in Table 2 of 3 parts by weight was dispersed uniformly in a silicone solution for hard coating of 100 parts by weight referred to as solids. A surface of a belt sleeve (a type shown in FIG. 1) made of aluminium was coated uniformly with the above obtained dispersion solution by a dipping method. The coated dispersion solution was dried with air for 30 minutes and then cured by heat at 150° C. for 1 hour to form a silicone resin coating layer of 5 μm in thickness on the surface of the sleeve. Thus obtained sleeve is called sleeve A.

PRODUCTION EXAMPLE B OF A COATING LAYER ON THE SURFACE OF A SLEEVE

An imidazole compound shown in Table 2 of 3 parts by weight was dispersed uniformly in a silicone solution for hard coating of 100 parts by weight referred to as solids. A surface of a belt sleeve of 40 μm in thickness (a type shown in FIG. 2) made of nickel which was prepared by nickel-electroforming method was coated uniformly with the above obtained dispersion solution by a spraying method. The sprayed dispersion solution was dried with air for 30 minutes and then cured by heat at 150° C. for 1 hour to form a silicone resin coating layer of 6 μm in thickness on the surface of the sleeve. Thus obtained sleeve is called sleeve B.

PRODUCTION EXAMPLE C OF A COATING LAYER ON THE SURFACE OF A SLEEVE

Sleeve C having a coating layer of a silicone resin of 6 μm in thickness was prepared in a manner similar to the production method of Sleeve A, except that Nigrosine base EX (made by Orient Kagaku Kogyo K.K.) of 3 parts by weight was used instead of an imidazole compound.

EXAMPLE 1

A copying machine EP-50 made by Minolta Camera K.K.), which is a single component developing system, was remodeled to install a positive chargeable photosensitive member of selenium type and a developing apparatus as shown in FIG. 1 equipped with Blade A.

Toner A, which was prepared as below, was used in the remodeled copying machine to evaluate various kinds of properties such as an image quality at an initial stage, durability test with respect to copy and the like.

The results were summarized in Table 1.

Preparation of Toner A

| ingredient | parts by weight |
|---|---|
| polyester resin (softening point: 130° C., glass transition point: 60° C., AV25, OHV 38) | 100 |
| carbon black (MA#8: made by Mitsubishi Kasei) | 8 |

-continued

| Preparation of Toner A | |
|---|---|
| ingredient | parts by weight |
| polypropyrene of oxidized type (Biscol TS-200; made by Sanyo Kasei Kogyo K.K.) | 2 |

The above ingredients were mixed sufficiently in a ball mill, and kneaded over a three-roll heated to 140° C. The kneaded mixture was left to stand for cooling the same, and then, was coarsely pulverized with the use of a feather mill. The obtained coarse particles were further pulverized by a jet mill, followed by being air-classified to obtain fine particles of an average particle size of 11 μm.

The obtained particles of 100 parts by weight were treated with Colloidal Silica R-974 (made by Nihon Aerosil K.K.) of 0.2 parts by weight (Toner A). Colloidal Silica is not fixed on the surface of a toner particle.)

(Particle size measurement)

The measurement of a mean particle size of a toner was carried out with Coulter counter II (made by Coulter Counter K.K.), in which the relative weight distribution of each particle size was measured with an aperture tube of 100 μm.

The particle size of a carrier was measured with Microtruck Model 7995-10SRA (made by Nikkiso K.K.) to obtain a mean particle size.

Evaluation 1) fogs on copied image

It was observed whether there were fogs on copied images formed on a white ground. There were little fogs and good copied images were obtained. This results mean that a toner is charged sufficiently.

2) fogs on a ground

A sheet of paper, half of which was black, was copied to evaluate fogs formed on a white ground. There were little fogs in spite of the simultaneous duplication of black solid images. This means that the electrification build-up of a toner is fast and good copied images are formed stably in spite of a kind of manuscripts.

3) durability test with respect to copy

After the evaluation of initial copied images, the durability test with respect to copy of 100000 sheets of paper was carried out to evaluate copied images visually, with the result that stable copied images with little fogs were obtained in spite of the copy number of paper. This means that a coating layer, on a blade containing a charge controlling agent of the present invention exhibits excellent durability. There arose no problem such as fusion of a toner to a blade or the like.

EXAMPLE 2-5

A developing apparatus (shown by the number in the column of developing apparatus in Table 1 or Table 2 corresponding to the Figure number), a blade, and a sleeve shown in Table 1 or Table 2 were installed in a copying machine shown by FIG. 1 or FIG. 2 to evaluate the same as Example 1. The results were summarized in Table 1 and Table 2.

TABLE 1

| | | (with respect to blade) | | | | | | | | |
|---|---|---|---|---|---|---|---|---|---|---|
| | | blade | | fogs in copied | fogs on | durability test | | | | |
| | developing apparatus | compound | production example | image on white ground | white ground | 1000 | 5000 | 10000 | 50000 | 100000 |
| Example | | | | | | | | | | |
| 1-1 | 1 | I-3 | A | none | none | good | good | good | good | good |
| 1-2 | 1 | II-3 | A | none | none | good | good | good | good | good |
| 1-3 | 1 | VII-1 | A | none | none | good | good | good | good | good |
| 1-4 | 1 | VIII-3 | A | none | none | good | good | good | good | good |
| 1-5 | 1 | IX-2 | A | none | none | good | good | good | good | good |
| Example | | | | | | | | | | |
| 2-1 | 2 | I-4 | B | none | none | good | good | good | good | good |
| 2-2 | 2 | II-4 | B | none | none | good | good | good | good | good |
| 2-3 | 2 | VII-2 | B | none | none | good | good | good | good | good |
| 2-4 | 2 | VIII-4 | B | none | none | good | good | good | good | good |
| 2-5 | 2 | IX-4 | B | none | none | good | good | good | good | good |
| Example | | | | | | | | | | |
| 3-1 | 1 | I-3 | C | none | none | good | good | good | good | good |
| 3-2 | 1 | II-3 | C | none | none | good | good | good | good | good |
| 3-3 | 1 | VII-1 | C | none | none | good | good | good | good | good |
| 3-4 | 1 | VIII-3 | C | none | none | good | good | good | good | good |
| 3-5 | 1 | IX-2 | C | none | none | good | good | good | good | good |
| Comparative Example 1 | 1 | Nigrosine base EX | D | much | much | X | X | X | X | X |

In Examples 1-3 and Comparative Example 1, a sleeve made of aluminium was used in the developing apparatus 1 and an endless belt sleeve made of Nickel was used in the developing apparatus 2. In Comparative Example 1, the durability test was stopped after about 100 times of copy because fogs increased.

TABLE 2

| | | (with respect to sleeve) | | | | | | | | |
|---|---|---|---|---|---|---|---|---|---|---|
| | | sleeve | | fogs in copied | fogs on | durability test | | | | |
| | developing apparatus | compound | production example | image on white ground | white ground | 1000 | 5000 | 10000 | 50000 | 100000 |
| Example | | | | | | | | | | |

TABLE 2-continued

| | developing apparatus | sleeve (with respect to sleeve) compound | sleeve (with respect to sleeve) production example | fogs in copied image on white ground | fogs on white ground | durability test 1000 | 5000 | 10000 | 50000 | 100000 |
|---|---|---|---|---|---|---|---|---|---|---|
| 4-1 | 1 | I-10 | A | none | none | good | good | good | good | good |
| 4-2 | 1 | II-9 | A | none | none | good | good | good | good | good |
| 4-3 | 1 | VII-6 | A | none | none | good | good | good | good | good |
| 4-4 | 1 | VIII-8 | A | none | none | good | good | good | good | good |
| 4-5 | 1 | IX-9 | A | none | none | good | good | good | good | good |
| Example | | | | | | | | | | |
| 5-1 | 2 | I-4 | B | none | none | good | good | good | good | good |
| 5-2 | 2 | II-4 | B | none | none | good | good | good | good | good |
| 5-3 | 2 | VII-2 | B | none | none | good | good | good | good | good |
| 5-4 | 2 | VIII-4 | B | none | none | good | good | good | good | good |
| 5-5 | 2 | IX-14 | B | none | none | good | good | good | good | good |
| Comparative Example | | | | | | | | | | |
| 2 | 1 | Nigrosine base EX | C | much | much | X | X | X | X | X |
| 3 | 1 | — | — | notice-able | notice-able | X | X | X | X | X |

In Examples 4 and 5 and Comparative Examples 2 and 3, a blade made of phosphor bronze was used.

In Comparative Example 2, the durability test was stopped after about 100 times of copy because fogs increased.

In Comparative Example 3, the durability test was stopped because there were a lot of fogs.

| Production example A of a carrier | |
|---|---|
| ingredients | parts by weight |
| polyester resin (softening point: 123° C., glass transition point: 65° C., AV23, OHV 40) | 100 |
| inorganic magnetic particles (EPT-1000: made by Toda Kogyo K.K.) | 500 |
| carbon black (MA#8: made by Mitsubishi Kasei) | 2 |

The above ingredients were mixed sufficiently in a Henschel mixer, pulverized and fused and kneaded using an extrusion kneader wherein the temperature of cylinder and cylinder head was set to 180° C. and 170° C., respectively. The kneaded mixture was cooled, then pulverized in a jet mill, then classified using a classifier to obtain a magnetic carrier of an average particle diameter of 55 μm.

The obtained carrier is referred to as Carrier A.

Production example B of a carrier

Carrier B of 55 μm in average particle diameter was prepared in a manner similar to the production example Carrier A, except that an imidazole compound shown in Table of 3 of 3 parts by weight was further added.

Production example C of a carrier

Styrene-acrylic resin (Hymer SBM 73; made by Sanyo Kasei Kogyo K.K.) of 150 g was dissolved in toluene of 2 liters to prepare a coating solution.

Ferrite T-250HR (50 μm in average particle size; $3.50\times10^7$ Ω·cm in electrical resistance; made by Nihon Teppun K.K.) of 3000 parts by weight was sprayed with the above obtained coating solution in Spira-Cota 120 minutes under the conditions of 35 kg/cm$^2$ in spray pressure, 40 g/min. in spray amount and 50° C. in temperature. The obtained particles were filtered (through openings of 105 μm) to remove agglomerates. Thus, a coated carrier (a) was obtained.

Four hundred parts by weight of the obtained coated carrier and 2 parts by weight of an imidazole compound shown in Table 3 were treated in Mechanofusion System AM-015F (made by Hosokawa Micron K.K.) for 40 minutes at 1000 rpm. The obtained particles were filtered (through openings of 150 μm) to remove agglomerates. Thus obtained carrier is referred to as Carrier C of 52 μm in mean particle size.

| Production example D of a carrier (polymeric fine particles containing magnetic particles) | |
|---|---|
| ingredient | parts by weight |
| styrene-acrylic copolymer (SBM-73F: made by Sanyo Kasei Kogyo K.K.) | 100 |
| magnetic particles EPT-1000 (0.3–0.5 μm in mean particle size) | 200 |
| an imidazole compound shown in Table 3 | 5 |

The above ingredients were mixed in a Henschel mixer, pulverized and kneaded using a twin axial extruder. The kneaded mixture was cooled, pulverized coarsely and further pulverized in a jet mill, then classified using an classifier to obtain polymer particles of 3 μm in mean particles size containing a magnetic material and a charge controlling agent.

One hundred parts by weight of Ferrite carrier F-250HR (50 μm in mean particle size)(made by Nihon Teppun K.K.) and 5 parts by weight of the above obtained polymer particles were treated in Angmill AM-20F (made by Hosokawa Micron K.K.) for 40 minutes at 1000 rpm. Thus obtained carrier is referred to as Carrier D (55 μm in mean particle size.

EXAMPLES 6–8 AND COMPARATIVE EXAMPLE 4

Toner A was mixed with a carrier shown in Table 4 at the ratio of 7/93 (toner/carrier) to prepare a two-component developer.

Various kinds of properties such as an image quality at an initial stage and the durability test with respect to copy in Examples 6–8 and Comparative Example 4 using a copying machine EP-870 (made by Minolta Camera K.K.)

Two grams of the surface-treated toner A, and 28 g of each Carrier (A–D) were put in a poly bottle of a capacity of 50 cc, and the poly bottle was rotated on a rotating carriage at 1200 rpm. for 10 minutes. Then, the resultant charge amount and flying amount were measured so as to evaluate the electrification-build-up properties of the toner.

A charge amount and a flying amount were measured after a toner and a carrier which were put in a poly bottle as above mentioned were kept for 24 hours under conditions of 35° C. in temperature and 85% in relative humidity.

The flying amount was measured with the use of a digital dust measuring apparatus of P5H2 type (made by Shibata Kagakusha K.K.). The dust measuring apparatus was spaced 10 cm apart from a magnet roll, and 2 g of the developer was set on the magnet roll, which was rotated at 2,000 rpm. Then, the dust measuring apparatus detected the toner particles flying about as dust, and displayed the resultant value in the number of counts per minute, i.e. cpm.

The obtained flying amounts were ranked as below;
300 cpm or less : O
500 cpm or less : Δ
more than 500 cpm : x When the rank is "Δ" or "O", a carrier can be sufficiently put into practical use. Preferable rank is "O". The results are shown in Table 3.

2) fogs on copied image

Developers obtained in Examples 4–6 and Comparative Example 4 were used in EP-870 to evaluate fogs in copied images formed on a white ground. The evaluations were ranked. When the rank is "Δ" or "O", a carrier can be sufficiently put into practical use. Preferable rank is "O". The results are shown in Table 3.

Developers obtained in Examples 4–6 and Comparative Example 4 were used in EP-870 to evaluate fogs in copied images formed on a white ground. The evaluations were ranked. When the rank is "Δ" or "O", a carrier can be put into practical use. Preferable rank is "O".

3) durability test with respect to copy

The durability test of 100000 sheets of paper was carried out by copying a chart of 6% in B/W ratio with EP-570Z to evaluate copied images and fogs. The obtained results were shown in Table 3. In Table 3, the mark "O" means that a carrier can be put into practical use and the mark "x" means that there are some problems when a carrier is put into practical use.

4) Humidity resistance test

A copying machine of EP-570Z was kept for 24 hours under 35° C. in temperature and 85% in relative humidity, and then used to evaluate copied images, a charge amount and a toner flying amount. The marks "O" and "x" mean the same as above mentioned.

TABLE 3

| | carrier | compound | (with respect to carrier) initial stage | | | humidity resistance | | | durability to copy | | | | |
|---|---|---|---|---|---|---|---|---|---|---|---|---|---|
| | No. | No. | Q/M | flying | fogs | Q/M | flying | fogs | 1000 | 5000 | 10000 | 50000 | 100000 |
| Example 6-1 | B | I-4 | −14 | ○ | ○ | −14 | ○ | ○ | ○ | ○ | ○ | ○ | ○ |
| Example 6-2 | B | II-4 | −14 | ○ | ○ | −14 | ○ | ○ | ○ | ○ | ○ | ○ | ○ |
| Example 6-3 | B | VII-13 | −13 | ○ | ○ | −12 | ○ | ○ | ○ | ○ | ○ | ○ | ○ |
| Example 6-4 | B | VIII-4 | −14 | ○ | ○ | −14 | ○ | ○ | ○ | ○ | ○ | ○ | ○ |
| Example 6-5 | B | IX-4 | −14 | ○ | ○ | −14 | ○ | ○ | ○ | ○ | ○ | ○ | ○ |
| Example 6-6 | B | X-4 | −15 | ○ | ○ | −15 | ○ | ○ | ○ | ○ | ○ | ○ | ○ |
| Example 6-7 | B | XI-5 | −13 | ○ | ○ | −12 | ○ | ○ | ○ | ○ | ○ | ○ | ○ |
| Example 6-8 | B | II-3 | −16 | ○ | ○ | −16 | ○ | ○ | ○ | ○ | ○ | ○ | ○ |
| Example 7-1 | C | I-3 | −13 | ○ | ○ | −13 | ○ | ○ | ○ | ○ | ○ | ○ | ○ |
| Example 7-2 | C | II-3 | −13 | ○ | ○ | −13 | ○ | ○ | ○ | ○ | ○ | ○ | ○ |
| Example 7-3 | C | VII-2 | −13 | ○ | ○ | −13 | ○ | ○ | ○ | ○ | ○ | ○ | ○ |
| Example 7-4 | C | VIII-3 | −13 | ○ | ○ | −13 | ○ | ○ | ○ | ○ | ○ | ○ | ○ |
| Example 7-5 | C | IX-2 | −13 | ○ | ○ | −13 | ○ | ○ | ○ | ○ | ○ | ○ | ○ |
| Example 7-6 | C | X-5 | −14 | ○ | ○ | −14 | ○ | ○ | ○ | ○ | ○ | ○ | ○ |
| Example 7-7 | C | XI-4 | −13 | ○ | ○ | −14 | ○ | ○ | ○ | ○ | ○ | ○ | ○ |
| Example 7-8 | C | II-33 | −16 | ○ | ○ | −16 | ○ | ○ | ○ | ○ | ○ | ○ | ○ |
| Example 7-9 | C | II-36 | −13 | ○ | ○ | −14 | ○ | ○ | ○ | ○ | ○ | ○ | ○ |
| Example 7-10 | C | II-45 | −14 | ○ | ○ | −14 | ○ | ○ | ○ | ○ | ○ | ○ | ○ |
| Example 8-1 | D | I-4 | −12 | ○ | ○ | −12 | ○ | ○ | ○ | ○ | ○ | ○ | ○ |
| Example 8-2 | D | II-4 | −12 | ○ | ○ | −12 | ○ | ○ | ○ | ○ | ○ | ○ | ○ |
| Example 8-3 | D | VII-1 | −11 | ○ | ○ | −11 | ○ | ○ | ○ | ○ | ○ | ○ | ○ |
| Example 8-4 | D | VIII-4 | −12 | ○ | ○ | −12 | ○ | ○ | ○ | ○ | ○ | ○ | ○ |
| Example 8-5 | D | IX-4 | −12 | ○ | ○ | −12 | ○ | ○ | ○ | ○ | ○ | ○ | ○ |
| Comparative Example 4 | A | — | −9 | Δ | Δ | −4 | x | x | x | — | — | — | — |

In Comparative Example 4, the durability test was stopped after 1000 times of copy because there generated a lot of fogs.

What is claimed is:

1. Charging means which contacts with a toner to charge the toner and being installed in a developing machine for developing electrostatic latent images by a dry developer, said charging means contains on a toner contacting surface an imidazole compound selected from the group consisting of an imidazole metal complex represented by the general formula [I] below, an imidazole metal compound represented by the general formula [II] below; and an imidazole derivative represented by the general formula [III] below;

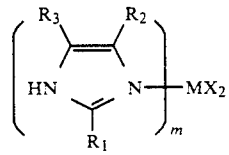

[I]

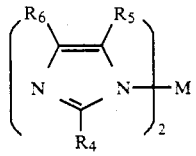

[II]

-continued

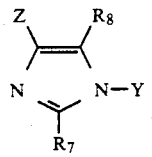

[III]

wherein $R_1$, $R_4$ and $R_7$ are respectively an alkyl group, an aralkyl group or an aryl group; $R_2$, $R_3$, $R_5$, $R_6$ and $R_8$ are respectively a hydrogen atom, an alkyl group, an aralkyl group or an aryl group; M is a metal selected from the group consisting of Zn, Fe, Co, Ni, Cu and Hg; X represents a halogen atom, a hydroxy group or an ionic residual group of one valency; m is an integer of 2, 4 or 6 and being 2 or 4 when M is Fe or Ni, 2, 4 or 6 when M is Cu or Co, and 2 when M is Zn or Hg; Y represents a hydrogen atom or a group represented by the formula [IV];

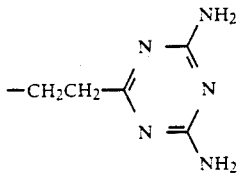

[IV]

Z represents an hydrogen atom, an alkyl group, an aralkyl group, an aryl group, a group represented by the general formula [V] below;

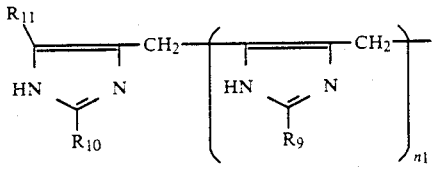

[V]

or a group represented by the general formula [VI];

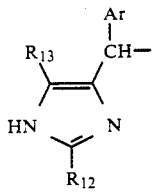

[VI]

wherein $R_9$, $R_{10}$ and $R_{12}$ are respectively an alkyl group, an aralkyl group or an aryl group; $R_{11}$ and $R_{13}$ are respectively a hydrogen atom, an alkyl group, an aralkyl group or an aryl group; Ar is an aryl group or a residual group of heterocyclic ring; $n_1$ is zero or an integer of more than 1.

2. Charging means of claim 1, wherein the imidazole derivative represented by the general formula [III] is an imidazole derivative represented by the general formula [VII] below;

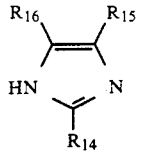

[VII]

wherein $R_{14}$ is a $C_8$–$C_{30}$ alkyl group, $R_{15}$ and $R_{16}$ are independently a hydrogen atom, a lower alkyl group, an aralkyl group or an aryl group.

3. Charging means of claim 1, wherein the imidazole derivative represented by the general formula [III] is an imidazole derivative represented by the general formula [VIII] below;

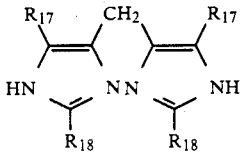

[VIII]

wherein $R_{17}$ and $R_{18}$ are independently a hydrogen atom, an alkyl group, an aralkyl group or an aryl group.

4. Charging means of claim 1, wherein the imidazole derivative represented by the general formula [III] is an imidazole derivative represented by the general formula [IX] below;

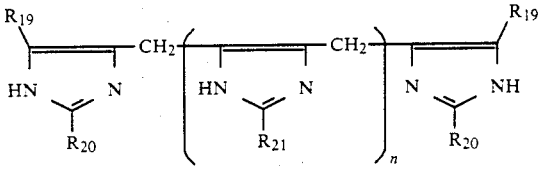

[IX]

wherein $R_{19}$, $R_{20}$ and $R_{21}$ are independently a hydrogen atom, an alkyl group, an aralkyl group or an aryl group; $n_2$ is an integer of 1 or more.

5. Charging means of claim 1, the imidazole derivative represented by the general formula [III] is an imidazole derivative represented by the general formula [X] below;

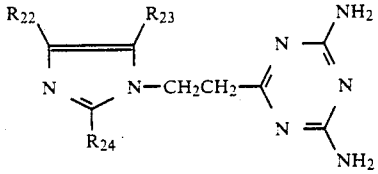

[X]

wherein $R_{22}$ and $R_{23}$ are independently a hydrogen atom, an alkyl group, an aralkyl group or an aryl group which may have a substituent; $R_{24}$ is an alkyl group, an aralkyl group or an aryl group, each of which may have a substituent.

6. Charging means of claim 1, the imidazole derivative represented by the general formula [III] is an imidazole derivative represented by the general formula [XI] below;

[XI]

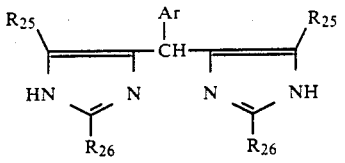

wherein $R_{25}$ is an alkyl group; $R_{26}$ is an alkyl group, an aralkyl group, or an aryl group, each of which may have a substituent; Ar is an aryl group, or a residual group of heterocyclic ring, each of which may have a substituent.

7. A developing device for developing an electrostatic latent image with a dry developer, comprising a toner transport member for transporting a toner to the electrostatic latent image; the toner transport member being arranged oppositely to an electrostatic latent image support to support the toner on the outersurface thereof;

a toner levelling member for levelling a toner provided for the toner transport member; and charging means for charging a toner in contact with the toner;

said charging means contains on a toner contacting surface an imidazole compound selected from the group consisting of an imidazole metal complex represented by the general formula [I] below, an imidazole metal compound represented by the general formula [II] below; and an imidazole derivative represented by the general formula [III] below;

[I]

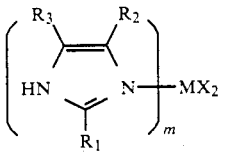

[II]

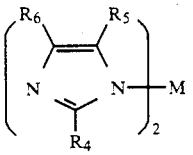

[III]

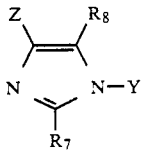

wherein $R_1$, $R_4$ and $R_7$ are respectively an alkyl group, an aralkyl group or an aryl group; $R_2$, $R_3$, $R_5$, $R_6$ and $R_8$ are respectively a hydrogen atom, an alkyl group, an aralkyl group or an aryl group; M is a metal selected from the group consisting of Zn, Fe, Co, Ni, Cu and Hg; X represents a halogen atom, a hydroxy group or an ionic residual group of one valency; m is an integer of 2, 4 or 6 and being 2 or 4 when M is Fe or Ni, 2, 4 or 6 when M is Cu or Co, and 2 when M is Zn or Hg; Y represents a hydrogen atom or a group represented by the formula [IV];

[IV]

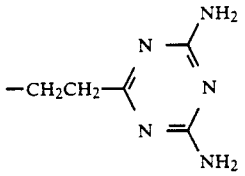

Z represents an hydrogen atom an alkyl group, an aralkyl group, an aryl group, a group represented by the general formula [V] below;

[V]

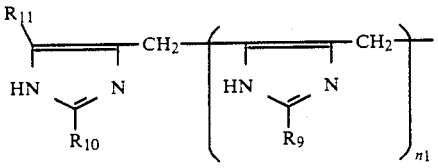

or a group represented by the general formula [VI];

[VI]

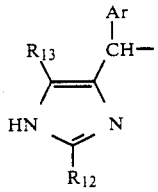

wherein $R_9$, $R_{10}$ and $R_{12}$ are respectively an alkyl group, an aralkyl group or an aryl group; $R_{11}$ and $R_{13}$ are respectively a hydrogen atom, an alkyl group, an aralkyl group or an aryl group; Ar is an aryl group or a residual group of heterocyclic ring; $n_1$ is zero or an integer of more than 1.

8. A developing device of claim 7, wherein the charging means is said toner levelling member.

9. A developing device of claim 8, wherein an imidazole compound represented by the general formula [I], [II] or [III] of claim 7 is dispersed in the toner levelling member.

10. A developing device of claim 8, wherein the toner levelling member is coated with a layer comprising an imidazole compound represented by the general formula [I], [II] or [III] of claim 7.

11. A developing device of claim 10, wherein the layer comprises an imidazole compound represented by the general formula [I], [II] or [III] of claim 7 dispersed in a resin.

12. A developing device of claim 10, wherein the layer is a ceramic hard coating layer with an imidazole compound represented by the general formula [I], [II] or [III] of claim 7 dispersed therein.

13. A developing device of claim 10, wherein an imidazole compound represented by the general formula [I], [II] or [III] of claim 7 is 10 μm or less in mean particle size.

14. A developing device of claim 11, wherein an imidazole compound represented by the general formula [I], [II] or [III] of claim 7 is contained at a content of 0.01–20 parts by weight on the basis of 100 parts by weight of the resin.

15. A developing device of claim 11, wherein the layer is 0.1–500 μm in thickness.

16. A developing device of claim 12, wherein the layer is 0.5–10 μm in thickness.

17. A developing device of claim 7, wherein the charging means is said toner transport member.

18. A developing device of claim 17, wherein an imidazole compound represented by the general formula [I], [II] or [III] of claim 7 is dispersed in the toner transport member.

19. A developing device of claim 17, wherein the toner transport member is coated with a layer comprising an imidazole compound represented by the general formula [I], [II] or [III] of claim 7.

20. A developing device of claim 19, wherein the layer comprises an imidazole compound represented by the general formula [I], [II] or [III] of claim 7 dispersed in a resin.

21. A developing device of claim 19, wherein the layer is a ceramic hard coating layer with an imidazole compound represented by the general formula [I], [II] or [III] of claim 7 dispersed therein.

22. A developing device of claim 19, wherein an imidazole compound represented by the general formula [I], [II] or [III] of claim 7 is 10 μm or less in mean particle size.

23. A developing device of claim 20, wherein an imidazole compound represented by the general formula [I], [II] or [III] of claim 7 is contained at a content of 0.01–20 parts by weight on the basis of 100 parts by weight of the resin.

24. A developing device of claim 20, wherein the layer is 0.1–500 μm in thickness.

25. A developing device of claim 21, wherein the layer is 0.5–10 μm in thickness.

26. A developing device of claim 19, wherein the sleeve is 0.5–10 μm in surface roughness.

27. A developing device of claim 19, wherein fine particles are added to the layer to form irregularities on the surface of the layer.

28. A developing device of claim 17, wherein the sleeve is a cylindrical thin layer and having a peripheral length slightly longer than that of a developing roller so as to be loosely mounted.

29. A developing device of claim 7, wherein the dry developer comprises toner and carrier in which said carrier charging means.

30. A developing device of claim 29, wherein the carrier comprises a resin, a magnetic particle and an imidazole compound represented by the general formula [I], [II] or [III] of claim 7, the magnetic particle and the imidazole compound are dispersed in the resin.

31. A developing device of claim 29, wherein the magnetic particle is coated with the resin comprising the imidazole compound dispersed therein.

32. A developing device of claim 30, wherein an imidazole compound represented by the general formula [I], [II] or [III] is contained at the content of 0.01–20 parts by weight on the basis of the resin.

33. A developing device of claim 31, wherein an imidazole compound represented by the general formula [I], [II] or [III] is contained at the content of 0.001–10 parts by weight on the basis of the magnetic particle.

34. A developing method of electrostatic latent images comprising the steps:

charging a toner to a desired level by contacting the toner with charging means contains on a toner contacting surface an imidazole compound selected from the group consisting of an imidazole metal complex represented by the general formula [I] below, an imidazole metal compound represented by the general formula [II] below; and an imidazole derivative represented by the general formula [III] below;

providing the toner for electrostatic latent images formed on an electrostatic latent support;

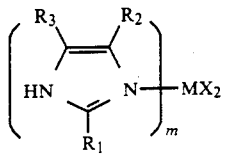

[I]

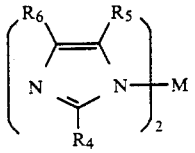

[II]

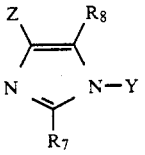

[III]

wherein $R_1$, $R_4$ and $R_7$ are respectively an alkyl group, an aralkyl group or an aryl group; $R_2$, $R_3$, $R_5$, $R_6$ and $R_8$ are respectively a hydrogen atom, an alkyl group, an aralkyl group or an aryl group; M is a metal selected from the group consisting of Zn, Fe, Co, Ni, Cu and Hg; X represents a halogen atom, a hydroxy group or an ionic residual group of one valency; m is an integer of 2, 4 or 6 and being 2 or 4 when M is Fe or Ni, 2, 4 or 6 when M is Cu or Co, and 2 when M is Zn or Hg; Y represents a hydrogen atom or a group represented by the formula [IV];

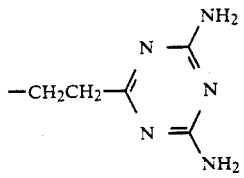

[IV]

Z represents an hydrogen atom, an alkyl group, an aralkyl group, an aryl group, a group represented by the general formula [V] below;

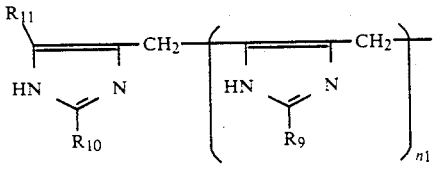

[V]

or a group represented by the general formula [VI];

[VI]

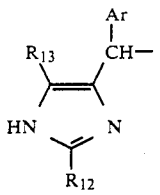

wherein $R_9$, $R_{10}$ and $R_{12}$ are respectively an alkyl group, an aralkyl group or an aryl group; $R_{11}$ and $R_{13}$ are respectively a hydrogen atom, an alkyl group, an aralkyl group or an aryl group; Ar is an aryl group or a residual group of heterocyclic ring; $n_1$ is zero or an integer of more than 1.

35. A developing method of claim 34, wherein the charging step comprises pressing a blade containing an imidazole compound represented by the general formula [I], [II] or [III] of claim 34 against a sleeve supporting a toner thereon to charge the toner at the moment the toner pass through between the sleeve and the blade.

36. A developing method of claim 34, wherein the charging step comprises pressing a blade against a sleeve comprising an imidazole compound represented by the general formula [I], [II] or [III] of claim 34 to charge a toner on a surface of the sleeve at the moment the toner pass through between the sleeve and blade.

37. A developing method of claim 34, wherein the charging means is a carrier.

* * * * *